US011320768B2

(12) United States Patent
Kataoka

(10) Patent No.: US 11,320,768 B2
(45) Date of Patent: May 3, 2022

(54) IMAGE HEATING APPARATUS AND IMAGE FORMATION APPARATUS WITH POWER SUPPLY CONTROL THAT SETS A TARGET TEMPERATURE FOR EACH OF A PLURALITY OF REGIONS OF RECORDING MATERIAL

(71) Applicant: CANON KABUSHIKI KAISHA, Tokyo (JP)

(72) Inventor: Hiroshi Kataoka, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/150,621

(22) Filed: Jan. 15, 2021

(65) Prior Publication Data

US 2021/0132529 A1 May 6, 2021

Related U.S. Application Data

(63) Continuation of application No. PCT/JP2019/027691, filed on Jul. 12, 2019.

(30) Foreign Application Priority Data

Jul. 18, 2018 (JP) ..... JP2018-134919

(51) Int. Cl.
*G03G 15/20* (2006.01)

(52) U.S. Cl.
CPC ..... *G03G 15/2039* (2013.01); *G03G 15/2064* (2013.01); *G03G 2215/2025* (2013.01)

(58) Field of Classification Search
CPC ..... G03G 15/2039; G03G 15/2042; G03G 15/2046; G03G 2215/2025
(Continued)

(56) References Cited

U.S. PATENT DOCUMENTS 11,029,627 B2 * 6/2021 Kataoka et al. ... G03G 15/2042
2002/0067935 A1 6/2002 McIntyre
(Continued)

FOREIGN PATENT DOCUMENTS

EP 3264194 A1 1/2018
JP S63313182 A 12/1988
(Continued)

OTHER PUBLICATIONS

International Search Report issued in Intl. Appln. No. PCT/JP2019/027691 dated Oct. 1, 2019. English translation provided.
(Continued)

*Primary Examiner* — William J Royer
(74) *Attorney, Agent, or Firm* — Rossi, Kimms & McDowell LLP

(57) ABSTRACT

An image heating apparatus includes an image heating portion including a heater, a tubular film having an inner surface in contact with the heater, and a pressure member that is in contact with the outer surface of the film and forms a nip portion for conveying a recording material between the outer surface and the pressure member. The image heating portion heats an unfixed toner image on the recording material by the heater. A temperature detection portion detects the temperature of the heater. A control portion controls electric power to the heater such that the temperature detected by the temperature detection portion is maintained at a predetermined control target temperature. An obtainment portion obtains image information for forming the unfixed toner image. The control target temperature is set, based on the image information, for each of a plurality of regions defined by dividing the recording material in the conveying direction.

20 Claims, 24 Drawing Sheets

(58) Field of Classification Search
USPC ..... 399/69, 334
See application file for complete search history.

(56) References Cited

U.S. PATENT DOCUMENTS

| | | | | |
|---|---|---|---|---|
| 2018/0004135 | A1 | 1/2018 | Sako | |
| 2018/0004136 | A1 | 1/2018 | Iwasaki | |
| 2019/0101854 | A1 | 4/2019 | Taguchi | |
| 2021/0247710 | A1* | 8/2021 | Sato | G03G 15/2042 |

FOREIGN PATENT DOCUMENTS

| | | | |
|---|---|---|---|
| JP | H0695540 | A | 4/1994 |
| JP | 2001100588 | A | 4/2001 |
| JP | 2007206327 | A | 8/2007 |
| JP | 4757046 | B2 | 8/2011 |
| JP | 2015034952 | A | 2/2015 |
| JP | 2016048402 | A | 4/2016 |
| JP | 2018004945 | A | 1/2018 |

OTHER PUBLICATIONS

Written Opinion issued in Intl. Appln. No. PCT/JP2019/027691 dated Oct. 1, 2019.
Extended European search report issued in European Appln. No. 19837330.0 dated Feb. 28, 2022.

* cited by examiner

| | $A_1$ | $A_2$ | $A_3$ | $A_4$ | $A_5$ | $A_6$ | $A_7$ |
|---|---|---|---|---|---|---|---|
| $T_1$ | AI | AI | AI | AI | AI | AI | AI |
| $T_2$ | AI | AI | AI | AI | AI | AI | AI |
| $T_3$ | AI | AI | AI | AI | AP | AP | AP |
| $T_4$ | AI | AI | AI | AI | AP | AP | AP |

| Image | Curl amount [mm] | |
|---|---|---|
| | Average value | Maximum value |
| Full secondary-color  | 4 | 7 |
| Full primary-color  | 7 | 9 |
| Table  | 10 | 16 |
| Characters  | 16 | 21 |

FULL SECONDARY - COLOR

FULL PRIMARY - COLOR

TABLE

| | | |
|---|---|---|
| 0123 | 456 | 78910ABC |
| 0124 | 457 | 78910ABC |
| 0125 | 458 | 78910ABC |
| 0126 | 459 | 78910ABC |
| 0127 | 460 | 78910ABC |
| 0128 | 461 | 78910ABC |
| 0129 | 462 | 78910ABC |
| 0130 | 463 | 78910ABC |
| 0131 | 464 | 78910ABC |
| 0132 | 465 | 78910ABC |
| 0133 | 466 | 78910ABC |
| 0134 | 467 | 78910ABC |
| 0135 | 468 | 78910ABC |

FIG. 21C

CHARACTERS

ABCDEFGHIJKLMNOPQRSTUVWXYZ

ABCDEFGHIJKLMNOPQRSTUVWXYZ

ABCDEFGHIJKLMNOPQRSTUVWXYZ

ABCDEFGHIJKLMNOPQRSTUVWXYZ

FIG. 21D

| Maximum toner amount/toner image occupancy ratio | Recording material in-process temperature control[°C] | | Image | Curl amount [mm] | | | |
|---|---|---|---|---|---|---|---|
| | | | | Average value | | Maximum value | |
| | Comparison example | Embodiment | | Comparison example | Embodiment | Comparison example | Embodiment |
| 200[%]/100[%] | +6 | +6 | Full secondary-color  | 4 | 4 | 7 | 7 |
| 100[%]/100[%] | +6 | +4 | Full primary-color  | 7 | 4 | 9 | 8 |
| 100[%]/16[%] | +6 | +2 | Table  | 10 | 3 | 16 | 9 |
| 100[%]/4[%] | +6 | +1 | Characters  | 16 | 3 | 21 | 7 |

IMAGE HEATING APPARATUS AND IMAGE FORMATION APPARATUS WITH POWER SUPPLY CONTROL THAT SETS A TARGET TEMPERATURE FOR EACH OF A PLURALITY OF REGIONS OF RECORDING MATERIAL

CROSS-REFERENCE TO RELATED APPLICATIONS

This application is a Continuation of International Patent Application No. PCT/JP2019/027691, filed Jul. 12, 2019, which claims the benefit of Japanese Patent Application No. 2018-134919, filed Jul. 18, 2018, which is hereby incorporated by reference herein in their entirety.

BACKGROUND OF THE INVENTION

Field of the Invention

The present invention relates to an image formation apparatus, such as a printer, a copier, and a facsimile machine, that uses an electrophotographic system or an electrostatic recording system. The present invention also relates to an image heating apparatus, such as a glossing apparatus that increases a gloss value of a toner image by reheating a fixing unit in the image formation apparatus and a toner image fixed to a recording material.

Background Art

A known image heating apparatus includes an endless belt (also referred to as a fixing film), a heater, which is in contact with the inner surface of the endless belt and generates heat when energized, and a roller, which forms a nip portion together with the heater via the endless belt. Such an image heating apparatus has a small heat capacity, and thus has excellent quick-start and power-saving capabilities.

In recent years, there has been a need to reduce power consumption and waiting time of image heating apparatuses provided in image formation apparatuses, such as copiers and laser printers. Applying a large amount of energy can shorten the start-up time required for an image heating apparatus to be ready for fixing, but this is not desirable in terms of energy saving. As such, improvements have been proposed including reducing the heat capacities of the components forming the image heating apparatus, reducing the thickness of the component that transfers heat as a means for increasing the thermal conductivity, and using a material having a higher thermal conductivity (PTL 1). These improvements have achieved film-heating image heating apparatuses capable of saving energy, as compared with conventional image heating apparatuses.

As an image heating apparatus that further saves the energy consumption, a configuration has been proposed that selectively heats toner image portions formed on a recording material (PTL 2). This configuration includes a division heater, the heating area of which is divided into a plurality of heating blocks arranged in the longitudinal direction of the heater (the direction perpendicular to the conveying direction of the recording material P). The division heater controls to selectively heat each heating block depending on the presence or absence of a toner image on the recording material. That is, a heating block corresponding to a portion of the recording material that is free of a toner image (an image-free portion) is not energized to save electric power.

To further save energy, improvements and modifications have been made to conventional configurations from various points of view, such as reducing the heat capacity by reducing the diameter and thickness of components, increasing the heat conduction and heat insulation of components, and selectively heating only a necessary image portion. Such image heating apparatuses are designed to reduce the heat capacity. As a result, the fixing member and the pressure member lose heat as a recording material passes through the fixing nip, lowering the fixing performance toward the trailing edge of the recording material. To solve this problem, a technique has been introduced that increases the target fixing temperature of the heater (hereinafter referred to as a control target temperature) while processing one recording material from the leading edge to the trailing edge, at intervals corresponding to the rotation cycle of the fixing member or the pressure member (hereinafter, this technique is referred to as a recording material in-process temperature control) (PTL 3).

As described above, the recording material in-process temperature control, which has been employed to accommodate the reduced heat capacities of image heating apparatuses, is designed to secure the fixing performance toward the trailing edge of a recording material even when the unfixed toner image formed on the recording material removes heat from the fixing member or the pressure member while passing through the fixing nip. An image having a large amount of toner removes a large amount of heat from the fixing member and the pressure member, lowering the fixing performance toward the trailing edge of the recording material. To avoid the heat amount becoming insufficient at the trailing edge of a recording material even when a toner image is formed over the whole area of the recording material and thus has a large amount of toner, the recording material in-process temperature control may provide optimum conditions by increasing the control target temperature toward the trailing edge, for example. This causes an image having a small amount of toner to receive an amount of heat that is greater than required. As a result, it has been found that a recording material that receives a heat amount greater than required can be warped. Such a phenomenon is called curling.

Further, an image heating apparatus that uses a division heater having a plurality of heating blocks may control to selectively heat only the toner image portion according to the image information. When the control target temperature is corrected to be higher toward the recording material trailing edge in the recording material in-process temperature control, a heating block with a toner image does not cause a problem because the toner image removes the heat. However, a heating block without a toner image suffers a temperature rise in the components toward the recording material trailing edge due to the absence of a toner image removing the heat. It is also found that when fixing is continuously performed in such a state, the portions of the fixing member or the pressure member corresponding to the image-free heating block undergo a significant temperature rise, thereby increasing the curling and reducing the durability.

Further, while the sections of the fixing member and the pressure member corresponding to the heating block without a toner image undergo a temperature rise, the temperatures of the sections of these members corresponding to the heating blocks with a toner image remain adequate, so that these members have varying surface temperatures along the longitudinal direction immediately after the recording material passes out of the fixing nip. The longitudinal direction is a direction perpendicular to the conveying direction of the recording material P. When the subsequent recording material reaches the fixing nip in such a state, hot offset can occur in the sections of the members having high temperatures. Hot offset is a phenomenon that occurs when the toner on a recording material receives an excessive amount of heat. Over-melted toner has a low viscosity and may be split (be parted) within the toner layer when the recording material is separated from the fixing film, leaving some toner on the fixing film. The toner remaining on the fixing film is fixed to the recording material after one rotation of the fixing film, staining the recording material.

It is an objective of the present invention to provide an image heating apparatus that can perform a more appropriate heating control according to the type of an image to be formed on a recording material.

CITATION LIST

Patent Literature

PTL 1 Japanese Patent Application Laid-open No. S63-313182

PTL 2 Japanese Patent Application Laid-open No. H06-95540

PTL 3 Japanese Patent No. 4757046

SUMMARY OF THE INVENTION

To achieve the above objective, the image heating apparatus of the present invention includes:

an image heating portion including a heater, a tubular film having an inner surface in contact with the heater, and a rotational pressure member that is in contact with the outer surface of the film and forms a nip portion for conveying a recording material between the outer surface and the pressure member, the image heating portion being configured to heat an unfixed toner image formed on the recording material using heat of the heater;

a temperature detection portion configured to detect the temperature of the heater;

a control portion configured to control electric power supplied to the heater such that the temperature detected by the temperature detection portion is maintained at a predetermined control target temperature; and an obtainment portion configured to obtain image information for forming the unfixed toner image, wherein the control target temperature is set, based on the image information, for each of a plurality of regions defined by dividing the recording material in a conveying direction, and the plurality of regions is a plurality of regions defined by dividing the recording material in the conveying direction by a circumferential length of one of the film and the pressure member.

To achieve the above objective, the image formation apparatus according to the present invention includes:

an image forming portion configured to form an unfixed toner image on a recording material; and a fixing portion configured to fix the unfixed toner image formed on the recording material to the recording material, wherein the fixing portion is the image heating apparatus according to the present invention.

Further features of the present invention will become apparent from the following description of exemplary embodiments (with reference to the attached drawings).

BRIEF DESCRIPTION OF THE DRAWINGS

FIGS. 21A-21D illustrate enlarged views of the four different image patterns corresponding to Full secondary-color, Full primary-color, Table, and Characters, respectively, of FIG. 21.

DESCRIPTION OF THE EMBODIMENTS

Figure 1:
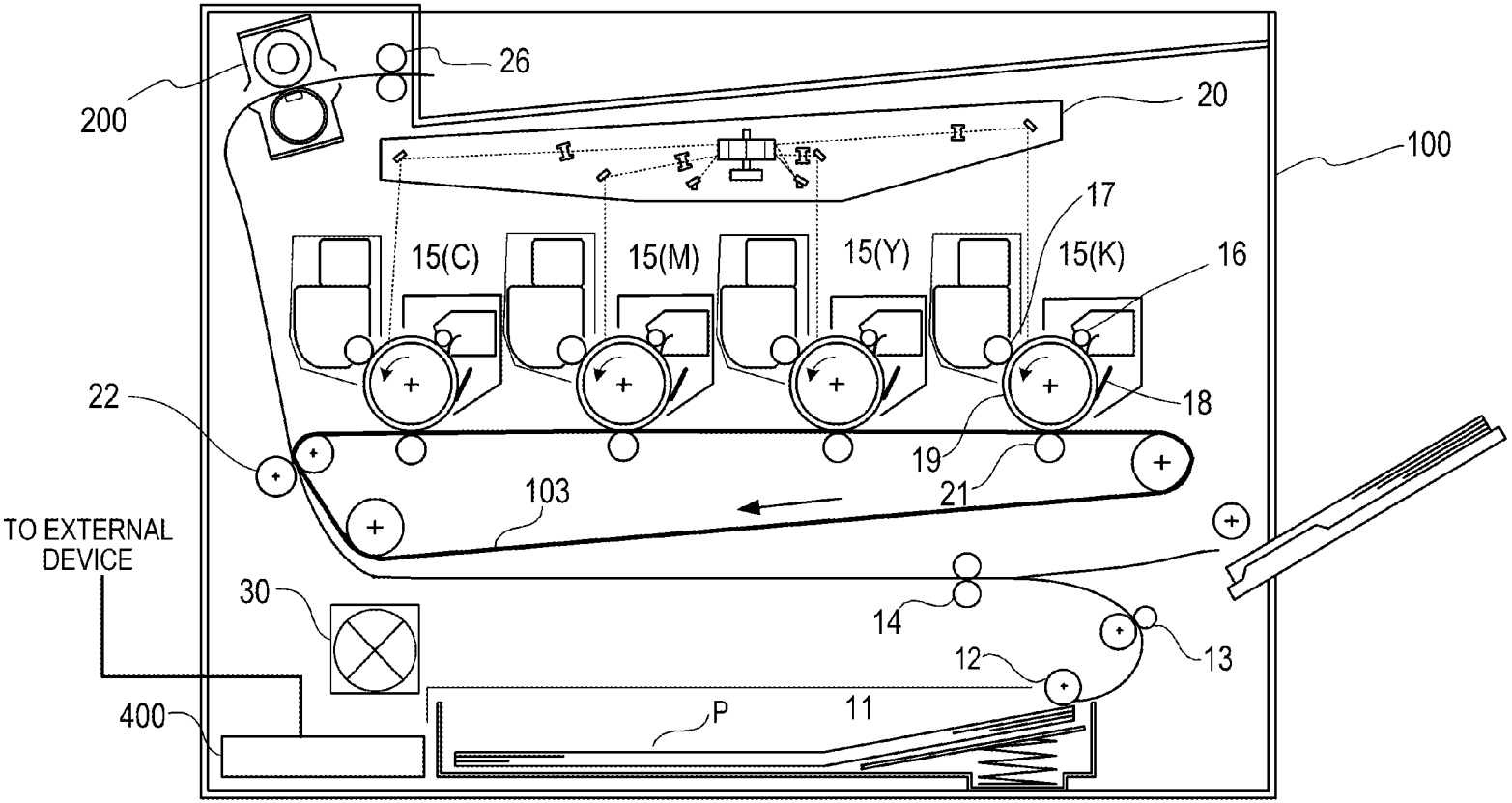
FIG. 1 is a cross-sectional view of an image formation apparatus of an embodiment according to the present invention.

Referring to the drawings, modes for carrying out the present invention are described in detail based on embodiments. However, the dimensions, materials, shapes, and relative arrangements of the components described in the embodiments may be modified as appropriate according to the configuration of the apparatus to which the invention is applied, and various conditions. That is, it is not intended to limit the scope of the present invention to the following embodiments.

Embodiment 1

1. Configuration of Image Formation Apparatus

FIG. 1 is a schematic cross-sectional view of an image formation apparatus of an embodiment according to the present invention. The present invention is applicable to image formation apparatuses such as printers, copier, and facsimile machines that use an electrophotographic system or an electrostatic recording system. In the example described below, the present invention is applied to a laser beam printer.

An image formation apparatus 100 of the present embodiment is a laser beam printer that receives print signals, which are image information sent from an external device such as a personal computer, and forms images on recording materials P using an electrophotographic system. The external device and the image formation apparatus 100 are connected via a control circuit 400 serving as a control portion in the image formation apparatus 100. When receiving a print signal from the external device, the control circuit 400 forms an image as follows.

A scanner unit 20 emits a laser beam modulated according to image information, and scans the surface of a photosensitive drum 19, which is charged with a predetermined polarity by a charging roller 16. A latent image is thus formed on the photosensitive drum 19. Toner (developer) is supplied to the latent image from a developing roller 17, developing the latent image on the photosensitive drum 19 into a toner image (a developer image). In the same manner, toner images of four colors are sequentially transferred to and superimposed on an intermediate transfer member (intermediate transfer belt) 103 by the transfer electric field applied to primary transfer rollers 21, forming a toner image consisting of a plurality of colors on the intermediate transfer member 103. The secondary transfer portion, which is formed by the intermediate transfer member 103 and a secondary transfer roller 22, secondary-transfers the toner image that has been transferred to the intermediate transfer member 103 to a recording material P by the transfer electric field applied to the secondary transfer roller 22.

Recording materials P are stacked and stored in a paper feed cassette 11. The recording materials P are fed one by one from the paper feed cassette 11 by a pickup roller 12, and are conveyed through a pair of conveying rollers 13 and a pair of resist rollers 14 and to the secondary transfer portion at the timing synchronized with toner images formed on the intermediate transfer member 103. A recording material P to which a toner image is transferred from the intermediate transfer member 103 of the secondary transfer portion is then heated and pressed by a fixing apparatus (image heating apparatus) 200 serving as a fixing portion (an image heating portion). The toner image is thus heated and fixed to the recording material P. The heating source of the fixing apparatus 200 generates heat when supplied with electric power by the control circuit 400. A pair of conveying rollers 26 discharges the recording material P carrying the fixed toner image onto a tray in the upper section of the image formation apparatus 100.

A photosensitive drum 19, a charging roller 16, a cleaning unit including a drum cleaner 18, a developing roller 17, and a developing unit containing toner are integrated as a process cartridge 15, which is configured to be attachable to and removable from the image formation apparatus 100. Four process cartridges 15 are provided for respective colors of cyan, magenta, yellow, and black, and have the same configuration except for the color of the contained toner.

The photosensitive drums 19, the charging rollers 16, the scanner unit 20, the developing rollers 17, the transfer rollers 21 and 22, and other components form an image forming portion for forming an unfixed toner image on a recording material P.

Various components of the image formation apparatus 100, including the fixing apparatus 200 and the process cartridges 15, are operated by the driving force obtained from a motor 30 serving as a driving source provided in the apparatus main body. The image formation apparatus 100 of this embodiment has a maximum paper passage width of 216 mm in a direction perpendicular to the conveying direction of the recording material P, and is capable of printing 40 sheets of A4-sized [210 mm×297 mm] plain paper per minute at a conveyance speed of 230 mm/sec.

2. Configuration of Fixing Apparatus (Image Heating Apparatus)

Figure 2:
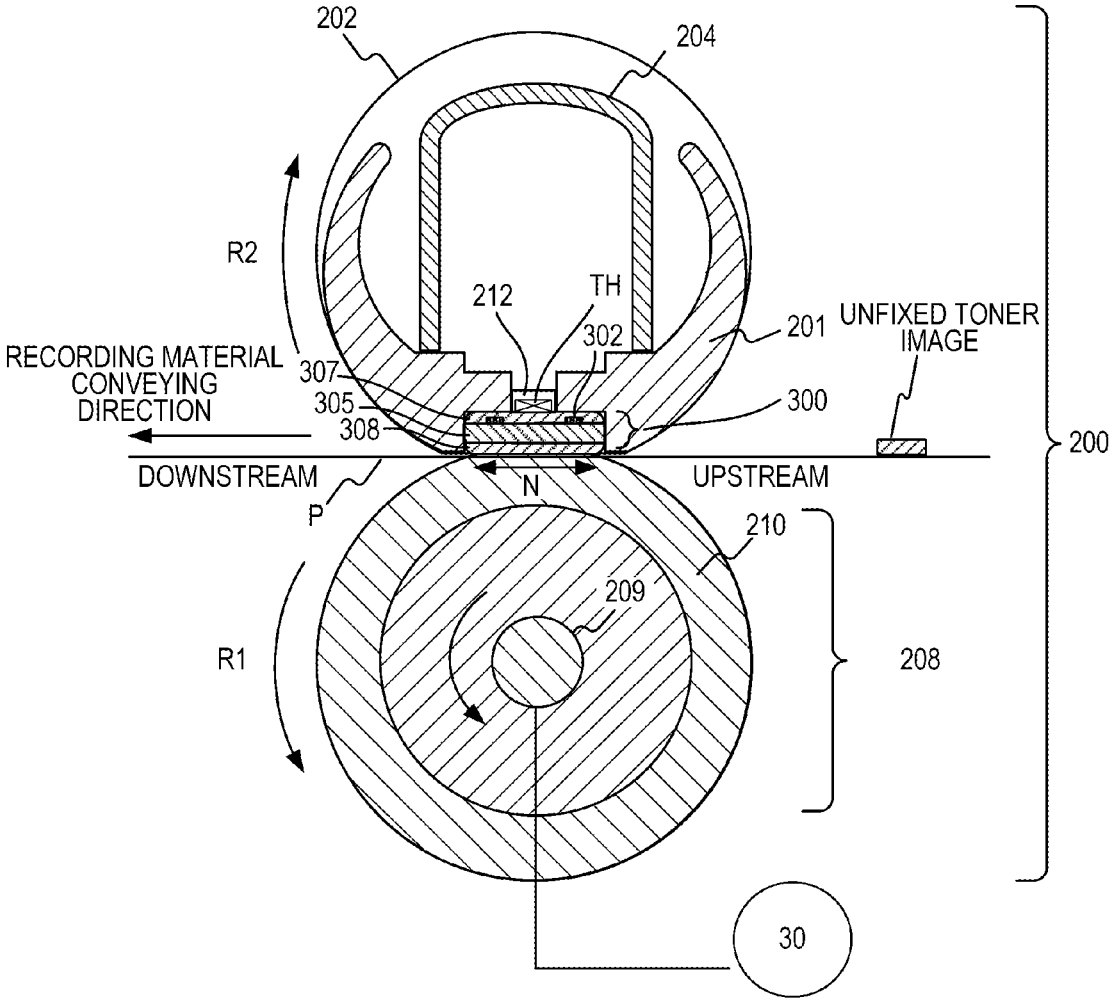
FIG. 2 is a cross-sectional view of an image heating apparatus of Embodiment 1 according to the present invention.

FIG. 2 is a schematic cross-sectional view of the fixing apparatus 200 of the present embodiment. The fixing apparatus 200 includes a fixing film 202 serving as an endless belt, a pressure roller 208 serving as a pressure member in contact with the outer surface of the fixing film 202, and a metal stay 204. The pressure roller 208 forms a fixing nip portion N together with a heater 300 via the fixing film 202.

The fixing film 202 is a highly heat-resistant fixing film 202 having a multi-layered tubular structure, and has a base layer of a heat-resistant resin, such as polyimide, or a metal, such as stainless steel. To improve heat resistance and prevent toner adherence, the surface of the fixing film 202 is coated with a highly functional fluororesin having excellent releasability, such as PFA, to form a release layer. Further, to improve the image quality, an elastic layer, which is of a highly heat-resistant rubber such as silicone rubber, may be formed between the base layer and the release layer. The fixing film 202 used in the present embodiment has an elastic layer and an outer diameter of 24 mm.

The pressure roller 208 includes a core metal 209, which is made of a material such as iron or aluminum, and an elastic layer 210, which is made of a highly heat-resistant rubber material such as silicone rubber. This configuration allows the pressure roller 208 to have an appropriate hardness, providing the fixing nip portion N that is in accordance with the specifications of the fixing apparatus 200. The pressure roller 208 of the present embodiment has a 4-mm-thick elastic layer and an outer diameter of 25 mm.

A heater including ceramic as the base material is used as the heater 300. That is, the heater 300 has a ceramic substrate 305, which may be made of alumina and has high electrical insulation, excellent thermal conductivity, and low heat capacity. On the surface of the ceramic substrate 305 opposite to the surface facing toward the fixing film 202, an energization heating resistance layer 302 (heating element) is formed by screen printing, for example. The energization heating resistance layer 302 extends in the longitudinal direction of the substrate (the direction perpendicular to the drawing plane, the direction perpendicular to the recording material conveying direction) and is made of silver-palladium, for example. Further, to insulate the energization heating resistance layer 302, the energization heating resistance layer 302 is covered with a thin protective glass layer 307 of about 50 μm.

The ceramic substrate 305 used in the present embodiment includes alumina ($Al_2O_3$) as the base material. On the surface of the ceramic substrate 305 that faces toward the inner surface of the fixing film 202, a slide glass layer 308 of about 10 μm is formed to provide sliding characteristics against the fixing film 202. To increase the sliding characteristics against the fixing film 202, fluorine-based grease (not shown) having a high heat resistance is applied to the slide glass layer 308.

When supplied with an AC voltage from the electrodes (not shown) at the two longitudinal ends of the heater 300, the energization heating resistance layer 302 generates heat, causing the temperature of the entire heater 300, including the ceramic substrate 305, the protective glass layer 307, and the slide glass layer 308, to rapidly rise. The temperature rise of the heater 300 is detected by thermistors TH (temperature detection elements), which are arranged on the back surface of the heater 300 and serve as a temperature detection portion, and is sent to the control circuit 400 as feedback. The control circuit 400 controls the electric power by controlling the phase and wave number of the AC voltage applied to the energization heating resistance layer 302 to maintain the temperature of the heater 300 detected by the thermistors TH at a predetermined control target temperature. The control circuit 400 maintains the control target temperature by the deviation integral differentiation (PID) control.

Further, safety elements 212, such as thermo-switches or temperature fuses, that operate in response to abnormal heating of the heater 300 and cut off the electric power supplied to the heater 300, are in direct contact with the heater 300, or in indirect contact through a heater holding member 201.

The heater 300, which is held by the heater holding member 201 made of heat-resistant resin, heats the inside of the fixing nip portion N to heat the fixing film 202. The heater holding member 201 also has a guide function of guiding the rotation of the fixing film 202. The metal stay 204 receives a pressing force (not shown) and presses the heater holding member 201 toward the pressure roller 208. The pressure roller 208 receives a rotational driving force from the motor 30 and rotates in the direction of Arrow R1. As the pressure roller 208 rotates, the fixing film 202 is driven to rotate in the direction of Arrow R2. A recording material P is held and conveyed through the fixing nip portion N while the unfixed toner image on the recording material P receives heat from the heater 300 through the fixing film 202 and is thus fixed.

3. Fixation Controls

Various controls are combined and performed as fixation controls.

First, the base control target temperature is described.

<Base Control Target Temperature>

The base control target temperature is used to control the energization of the heater 300 such that the surface temperature of the fixing film 202 is within a temperature range that does not cause faulty fixation. The lower limit of the temperature range is set to a temperature that does not cause faulty fixation (a phenomenon in which a toner image is not fixed to the recording material P as a permanent image), and the upper limit is set to a temperature that does not cause hot offset.

The correction control of the base control target temperature is now described.

<Stepwise Temperature Control>

The film-heating fixing apparatus 200 using the thin fixing film 202 as a fixing member includes components whose heat capacities are reduced to achieve quick start, which puts the fixing apparatus 200 into a state ready for fixing in an extremely short time.

A component with a small heat capacity has a small heat storage capacity. As such, continuous fixing with the control target temperature set to a constant temperature will increase the temperature of the component. This may lead to hot offset.

Figure 3:
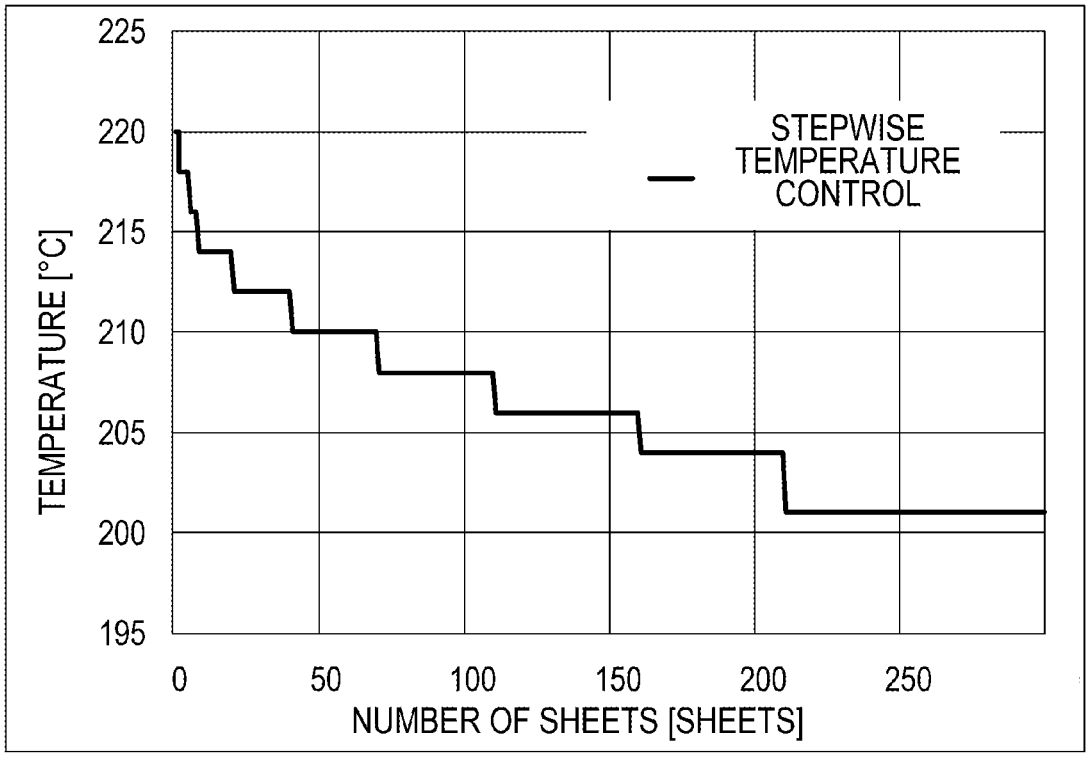
FIG. 3 is a diagram illustrating a temperature control of an embodiment according to the present invention.

For this reason, a stepwise temperature control may be incorporated that, as the temperature of the components rises, reduces the control target temperature in a stepwise manner according to the number of recording materials P to be fixed as shown in FIG. 3.

<Recording Material In-Process Temperature Control>

As described in the Background Art section, in the film-heating image heating apparatus with a small heat capacity, the surface temperatures of the fixing film 202 and the pressure roller 208 decrease as a recording material P passes through the fixing nip portion N. This may result in an insufficient heat amount applied toward the trailing edge of the recording material P.

Figure 4:
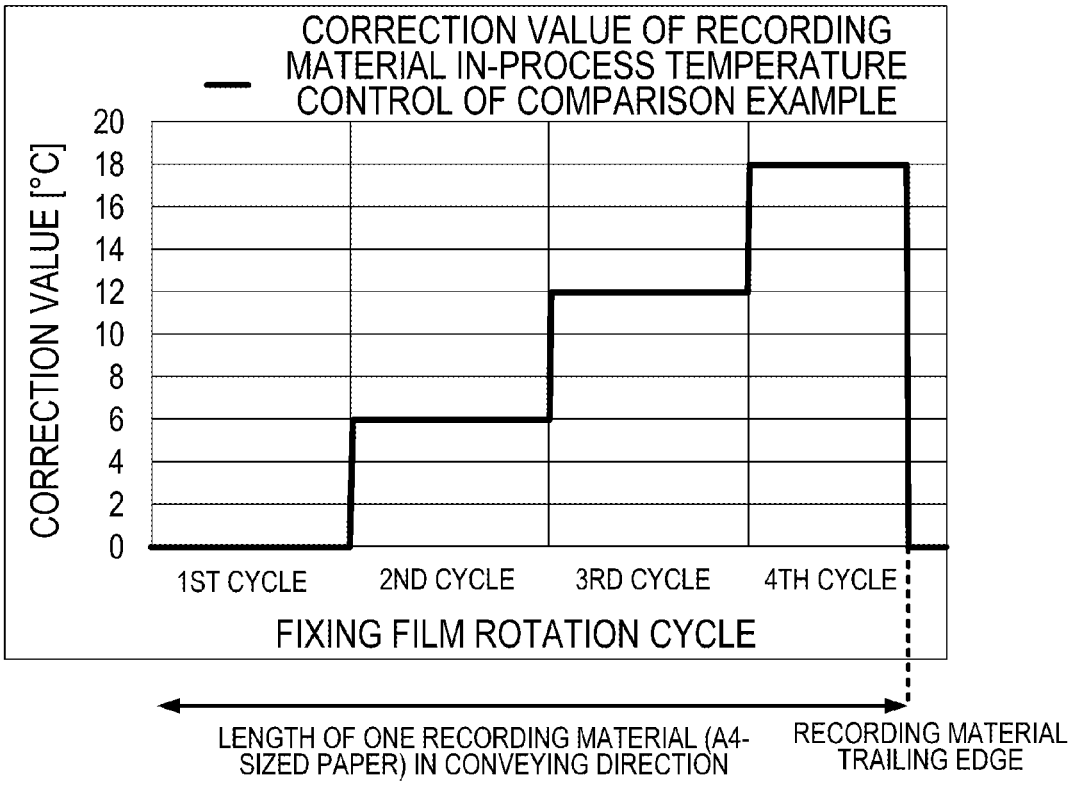
FIG. 4 is a diagram illustrating a temperature control of a comparison example of an embodiment according to the present invention.

To avoid such heat shortage, a recording material in-process temperature control may be incorporated that corrects and increases the control target temperature at intervals corresponding to the rotation cycle of the fixing film 202 or the pressure roller 208 while one recording material P is processed, as shown in FIG. 4. This achieves a uniform surface temperature of the fixing film 202 and the pressure roller 208 from the leading to trailing edges of the recording material P.

FIG. 4 shows an example of the recording material in-process temperature control used in a comparison example. In this example, a correction is made at each rotation cycle of the fixing film with a cumulative correction amount of +6 [° C.]. The correction value becomes 0° C. during the fourth rotation cycle of the fixing film because the A4-sized recording material passes out of the fixing nip at this timing. The temperature needs to be set in preparation for the subsequent recording material P. This timing varies depending on the size of the recording material P used.

<Fixing Unit Temperature-rise State Control>

A fixing unit temperature-rise state control may also be incorporated that is based on the temperature rise state of the fixing apparatus 200 that is determined by the temperature detected by thermistors TH at the start of fixing.

As shown in Table 1, the fixing unit temperature-rise state control determines that the temperature of the fixing apparatus 200 has risen when the detection temperature is high and corrects and lowers the control target temperature accordingly. When the detection temperature is low, the fixing apparatus 200 is determined to be in a cold state, and the control target temperature is corrected and increased accordingly. Table 1 shows the correction values for the fixing unit temperature-rise state control.

TABLE 1

| Initial detection temperature [° C.] | Correction value [° C.] |
|---|---|
| ~50 | 0 |
| 51~80 | −1 |

TABLE 1-continued

| Initial detection temperature [° C.] | Correction value [° C.] |
|---|---|
| 81~120 | −2 |
| 120~160 | −3 |
| 161~ | −4 |

<Paper Type Control>

Additionally, the control target temperature may be set according to the type of the recording material P. Examples of the types of recording material P include paper with a basis weight of 65 to 80 [g/m$^2$], which is widely used generally for clerical work, recording material P having a larger basis weight, glossy paper, envelopes, and label paper. A paper type control that accommodates various types of recording materials P may be incorporated, in which a control target temperature is set for each of the various recording materials P.

<Environmental Correction Control>

Furthermore, an environmental correction control may be used that detects the temperature and humidity of the environment in which the image formation apparatus 100 is placed with an environment detection means, such as a temperature/humidity sensor, and uses the control target temperature that is suitable for the environment. When the image formation apparatus 100 is placed in a low-temperature environment, the recording materials P and the toner have lower temperatures. The control target temperature is thus increased to prevent faulty fixation. In a high-temperature environment, the recording materials P and the toner have higher temperatures. The control target temperature is thus reduced to prevent hot offset and curling.

<Non-Paper Section Temperature-Rise Limiting Control>

Recording materials P that have smaller widths than a recording material P having the maximum width that can pass through the image formation apparatus 100 (LTR (216-mm-wide) in the present embodiment) include A5-sized (148-mm-wide) recording paper and envelopes of "Long No. 4" (90-mm-wide), which is a standard envelope size in Japan. Such a recording material P, when fed, does not remove a heat amount from the heater 300 in the regions through which the recording material P does not pass (i.e., non-paper portions). The excess heat that is not removed is accumulated in the non-paper portions of the fixing film 202 and the pressure roller 208. This causes a non-paper portion temperature-rise state, in which the temperature exceeds the control target temperature. When a wider recording material P is fed in this non-paper portion temperature-rise state, a part where the temperature is high in the non-paper portion can cause hot offset. Additionally, the temperature may exceed the heat resistant temperature of the components used in the fixing apparatus 200, causing problems such as deformation and melting.

To solve such problems, a non-paper portion temperature-rise limiting control may be employed that limits the temperature rise of the non-paper portion by detecting the temperature rise of the non-paper portion with thermistors positioned at the longitudinal ends of the heater 300 and lengthening the conveyance intervals of the recording materials P when the detected temperature reaches a fixed temperature, to lengthen the time period in which the heater 300 does not generate heat.

The various fixation controls described above may be performed to enable the fixing apparatus 200 to perform stable fixation regardless of the use conditions selected by the user. Of these various fixation controls, ones that are required according to the specifications of the image formation apparatus 100 and the fixing apparatus 200 are incorporated.

4. Recording Material In-Process Temperature Control

A recording material in-process temperature control that is proposed in the present invention is now described in detail.

The recording material in-process temperature control performs corrections so as not to degrade the fixing performance toward the trailing edge of a recording material P even under most adverse conditions in terms of fixing performance.

A recording material P and the toner image carried on the recording material P remove a heat amount from the fixing film 202 and the pressure roller 208. Although the paper type control functions to maintain the appropriate heat amount for the recording material P, the effect of the toner image depends on the amount of toner. A smaller toner amount removes a smaller amount of heat, and a greater toner amount removes a greater amount of heat.

With the color image formation apparatus of the present embodiment, a "full secondary-color" image, which has a secondary color of red, blue, or green on the whole area of the image, removes the largest amount of heat and thus has adverse effects on the fixing performance toward the trailing edge of the recording material P.

The conventional recording material in-process temperature control performs corrections with reference to an image that has the greatest adverse effects on the fixing performance toward the trailing edge of the recording material P. The conventional control therefore avoids faulty fixation with any types of images, but has the following issues.

Many image formation apparatuses are for office use and used rarely to print full secondary-color images. The images that are mainly used, which may be documents and tables, require a substantially lower amount of toner and thus a smaller amount of heat for fixing than full secondary-color images. As a result, an excessive amount of heat is given to a recording material P on which a toner image of a document or table is formed, and the discharged recording material P can curl due to the excessive amount of heat.

Figure 21:
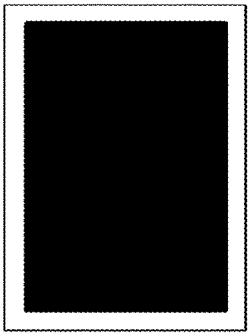
FIG. 21 is a result showing that the curling that resulted with four different image patterns was verified by using an image forming apparatus that corrects the temperature by +6 [° C.] at each fixing film rotation as the conventional recording material in-process temperature control.
Figure 21:
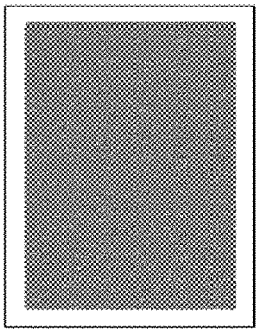
Figure 21:
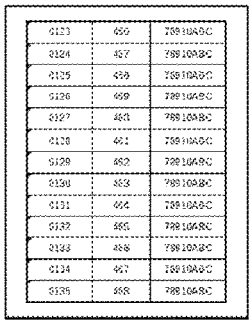
Figure 21:
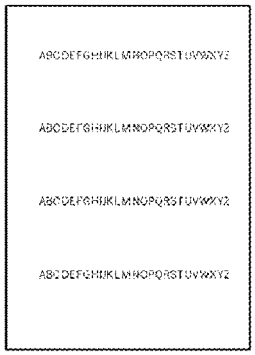
Figure 21A:
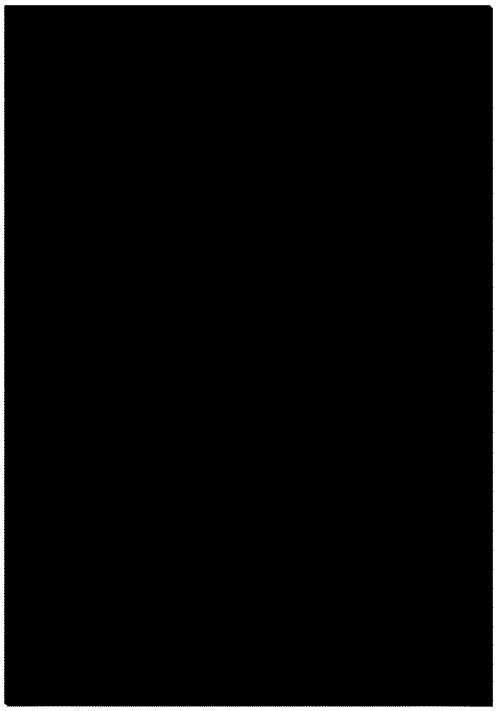
Figure 21B:
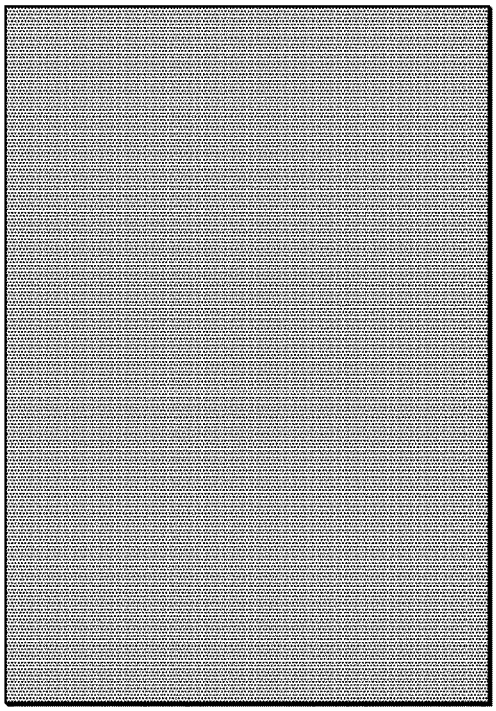

Using an image formation apparatus 100 that corrects the temperature by +6 [° C.] at each fixing film rotation as the conventional recording material in-process temperature control, the curling that resulted with different image patterns was verified. FIG. 21 shows the verification results. FIGS. 21A-21D illustrate enlarged views of the four different image patterns corresponding to Full secondary-color, Full primary-color, Table, and Characters, respectively, of FIG. 21. The verification was carried out under the following conditions.

Assuming a normal office environment, the verification was performed in an environment of 27° C./65%.

As the recording material P, PB PAPER, 64 [g/m$^2$] (manufactured by Canon Inc.), which had a tendency to curl and had a small basis weight, was used. The paper was let stand for one week before being fed for single-sided printing.

To set uniform conditions, after the fixing apparatus 200 was sufficiently cooled to the room temperature, ten sheets were continuously fed. The discharged recording materials P were placed on a flat plate, and the curl amounts at the four corners (the heights from the flat plate of the four corners that were warped upward from the flat plate) were measured. The numerical values in the table are the amounts of curling curved away from the printed surface. The average value is the average of a total of 40 data pieces of the four corners of the ten sheets, and the maximum value is the maximum value of the 40 data pieces.

The image patterns used were four image types including full secondary-color of red, which has the greatest adverse effects on the fixing performance, full primary-color of black, table with characters, and characters only.

As shown in FIG. 21, with the conventional recording material in-process temperature control, the full secondary-color, for which the conditions were optimized, had small curl amounts. However, with the conventional recording material in-process temperature control, it was found that the amounts of heat removed by the toner images of the table and the characters, which are widely used for office use, were small, and large amounts of heat were applied to the recording materials P, resulting in the large curl amounts.

To solve this problem, the present embodiment modifies the recording material in-process temperature control according to the information on the toner image to be printed on the recording material P. One advantageous effect of the present embodiment is that the curling is minimized.

First, the toner image information is described. Toner image information includes a maximum toner amount and a toner occupancy ratio.

The maximum toner amount is the maximum value of toner amounts in minimum pixels (unit pixels) and calculated by the following process flow.

Image data sent from an external device, such as a host computer, to the image formation apparatus 100 is converted into bitmap data by the control circuit 400, which serves as an obtainment portion and has a function of obtaining toner images. The number of pixels of the image formation apparatus 100 of this embodiment is 600 dpi, and the control circuit 400 generates bitmap data (image density data of each of CMYK colors) corresponding to the transmitted image data. Image data of each of CMYK colors is obtained for each pixel from the generated bitmap data, and d(C), d(M), d(Y), and d(K) are obtained as image data of the CMYK colors of each pixel. The total value of these data pieces is calculated as d(CMYK) for each pixel. This calculation is performed for all pixels of the entire recording material P.

The control circuit 400 uses 8-bit image signals. The image data of each color is represented in the range of the minimum density of 00 hex to the maximum density of FF hex. The total value of the colors d(CMYK) is represented by signals of two 8-bit bytes.

Since the maximum toner amount of each color is FF hex=100 [%], d(CMYK), which is the total value of the toner amounts of all colors, exceeds 100 [%]. However, the image formation apparatus 100 of the present embodiment is designed in terms of colors such that the maximum amount of toner on the recording material P is 230 [%].

The d(CMYK) value obtained by the calculation described above is used as the maximum toner amount.

An image with a maximum toner amount exceeding 100% involves a high image density on the recording material P and a large toner amount. Accordingly, a large amount of heat is needed to fuse and fix the toner, requiring a higher control target temperature.

Conventionally, the control target temperature is set to a temperature that achieves reliable fixing performance even for an image having such a maximum toner amount.

The calculation of the toner occupancy ratio is now described.

The toner occupancy ratio is the ratio (proportion) of the area where a toner image is actually formed to the area where a toner image is formable on the recording material P. The toner occupancy ratio is calculated such that the toner occupancy ratio=the number of pixels where an image is formed/the number of pixels where a toner image is formable. That is, the toner occupancy ratio is 100 [%] for an image in which a toner image is formed over the entire area, while the toner occupancy ratio is 0 [%] for an image in which a toner image is not formed.

The correction values used by the recording material in-process temperature control of the present embodiment are set as shown in Table 2 according to the toner image information of the maximum toner amount and the toner occupancy ratio calculated as described above. In the recording material in-process temperature control, a larger correction value is set for a larger maximum toner amount and a higher toner occupancy ratio, while a smaller correction value is set for a smaller maximum toner amount and a lower toner occupancy ratio. The control thus accommodates various images used by users.

TABLE 2

| Correction value of recording material in-process temperature control | | Maximum toner amount [%] | | | | | | |
|---|---|---|---|---|---|---|---|---|
| | | 105 or less | 106~120 | 120~141 | 141~170 | 141~170 | 171~200 | 201~230 |
| Toner occupancy ratio [%] | 0~10 | +1 | +2 | +2 | +3 | +3 | +4 | +4 |
| | 11~20 | +2 | +2 | +3 | +3 | +4 | +4 | +5 |
| | 21~40 | +2 | +3 | +3 | +4 | +4 | +5 | +6 |
| | 41~70 | +3 | +3 | +4 | +4 | +5 | +6 | +6 |
| | 71~100 | +4 | +4 | +5 | +5 | +6 | +6 | +6 |

5. Advantageous Effects of Present Embodiment

The advantageous effects of the present embodiment are now described. The advantageous effects were verified under the same conditions as the verification of curling of the comparison example described above. Of the image patterns used for the verification of curling of the comparison example described above, the maximum toner amounts and toner occupancy ratios are maximum toner amount: 200 [%]/toner occupancy ratio: 100 [%] for the full secondary-color, maximum toner amount: 100 [%]/toner occupancy ratio: 100 [%] for the full primary-color, maximum toner amount: 100 [%]/toner occupancy ratio 16 [%] for the table, and maximum toner amount: 100 [%]/toner occupancy ratio: 4 [%] for the characters.

Figure 5:
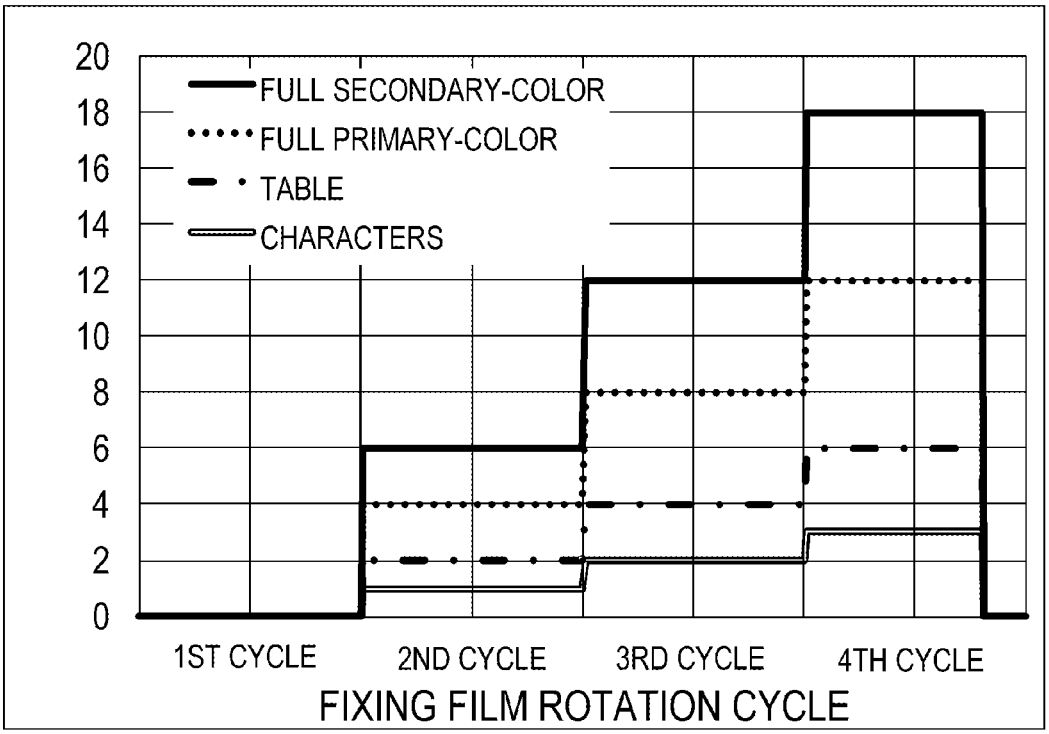
FIG. 5 is a diagram illustrating a temperature control of Embodiment 1 according to the present invention.

As shown in FIG. 5, the recording material in-process temperature control of the present embodiment uses the same correction value as the conventional control for the full secondary-color, but the correction values for the full primary-color, table, and characters, which involve less amounts of toner, are reduced according to Table 2. That is, the correction amount (the amount of increment of the control target temperature) cumulatively added from the leading edge region to the trailing edge region of the recording material is set according to the type and content of the unfixed toner image to be formed on the recording material. As such, the amount of heat applied to the recording material P is optimized by changing the correction value of the recording material in-process temperature control according to the toner image.

Figure 22:
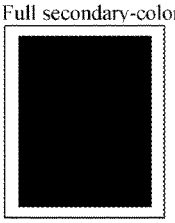
FIG. 22 is a result showing that the curling that resulted with the four different image patterns of FIG. 21 was verified by using an image forming apparatus of Embodiment 1 as the recording material in-process temperature control of Embodiment 1 according to the present invention.
Figure 22:
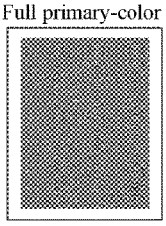
Figure 22:
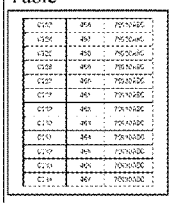
Figure 22:
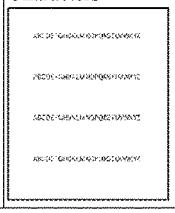

Referring to FIG. 22, the verification results of the advantageous effects are now described.

With the comparison example, it was verified that the curling was increased with the table and characters having low printing ratios. With the present embodiment, it was verified that the curling was not increased with the images of low printing ratios, and the curl amounts were equivalent to those of the full secondary-color.

Each of the images used in the present embodiment has a toner image over the entire area as shown in FIG. 22, and the recording material in-process temperature control corrects the temperature at each rotation cycle of the fixing film 202. However, the following derivative embodiments are also contemplated.

In one example, the temperature is not corrected when the trailing edge region of the recording material P does not have a toner image. In another example, if a toner image changes to another on one recording material P, the temperature is corrected according to the changed toner image information. The recording material in-process temperature control may include a combination of these examples, and the selection may be made as necessary.

As described above, Embodiment 1 according to the present invention performs the recording material in-process temperature control that is suitable for the toner image to be printed. This minimizes the curl amount regardless of the image pattern and achieves the fixing apparatus 200 that does not have the problem of curling.

In this embodiment, sections $T_i$ are set by the division based on the circumferential length of the fixing film 202, but the division may be based on the circumferential length of the pressure roller 208.

Embodiment 2

Figure 6A:
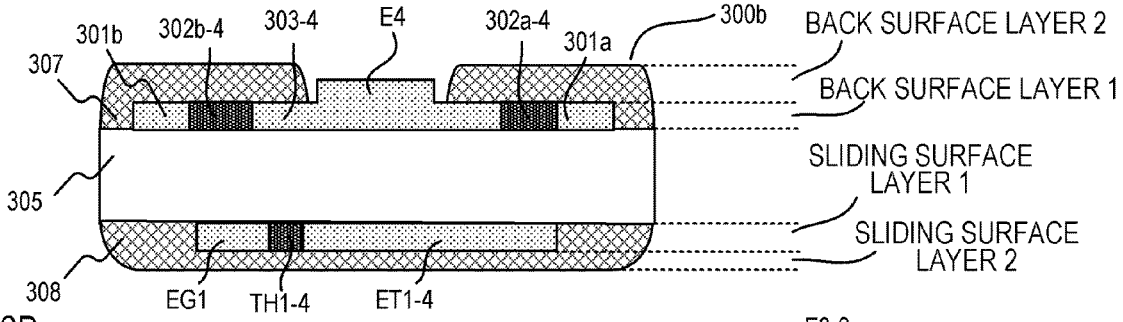
FIGS. 6A to 6C are diagrams showing the configuration of a heater of Embodiment 2 according to the present invention.
Figure 6B:
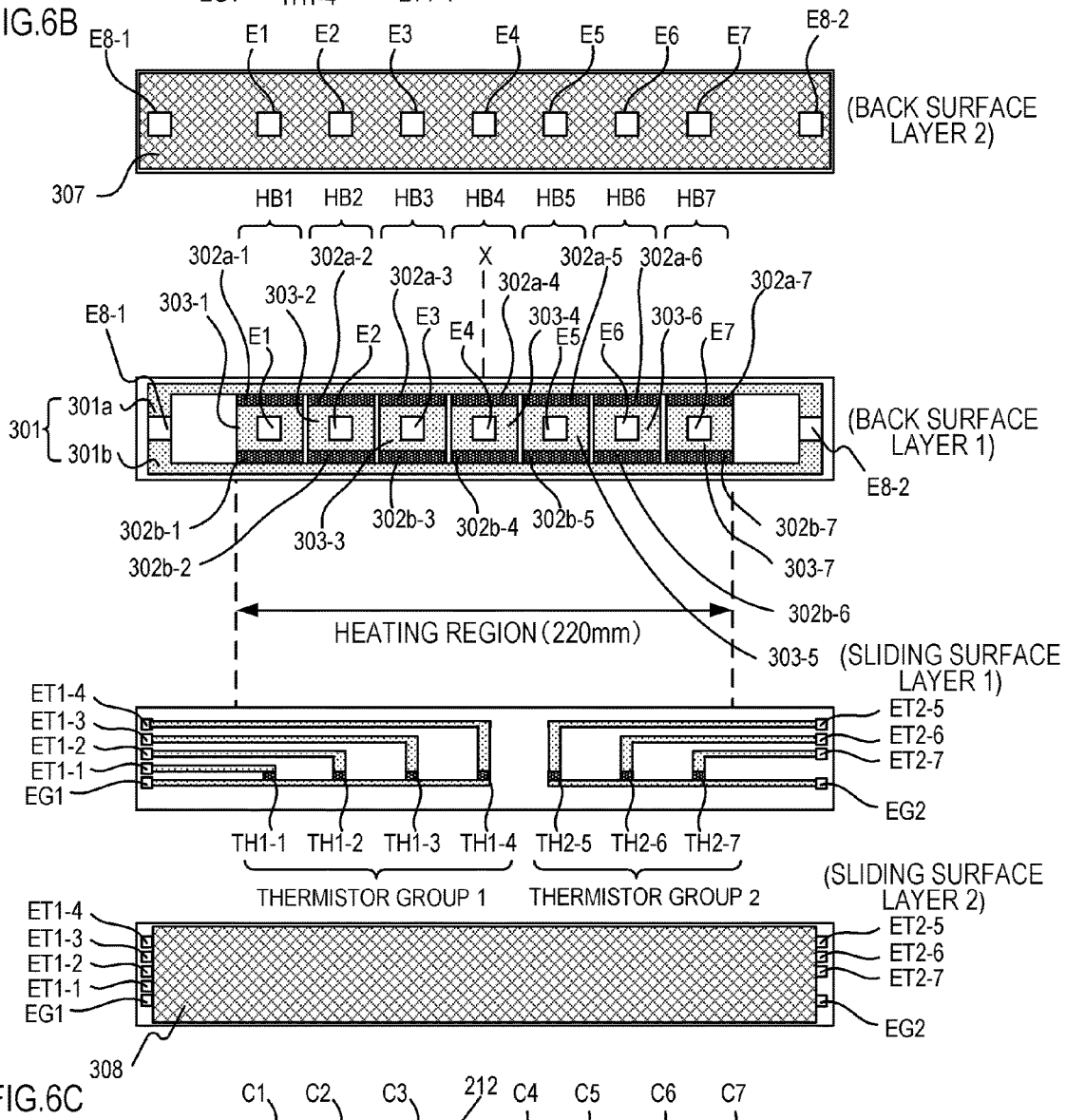
Figure 6C:
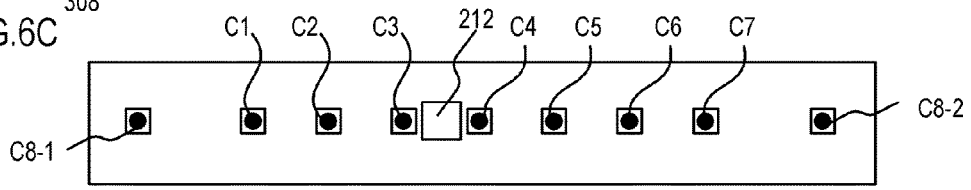

A fixing apparatus of Embodiment 2 according to the present invention is now described. Embodiment 2, which is an application example of Embodiment 1, relates to a fixing apparatus 200*b* (see FIG. 7) that employs a division heater having a plurality of heating elements. Referring to FIGS. 6A to 6C, the configuration of a division heater 300*b* of the present embodiment is first described.

1. Configuration of Heater 300*b* (Common to Division Heaters)

FIG. 6A is a cross-sectional view of the heater 300*b*, FIG. 6B is a plan view of each layer of the heater 300*b*, and FIG. 6C is a diagram illustrating a method for connecting electric contacts C to the heater 300*b*. FIG. 6B shows a conveyance reference position X for the recording material P in the image formation apparatus 100 of the present embodiment. The conveyance reference in this embodiment is the center reference, and the recording material P is conveyed such that its centerline extending through the center in the direction perpendicular to the conveying direction moves on the conveyance reference position X. FIG. 6A is a cross-sectional view of the heater 300*b* taken at the conveyance reference position X.

The heater 300*b* includes a ceramic substrate 305, a back surface layer 1 provided on the substrate 305, a back surface layer 2 covering the back surface layer 1, a sliding surface layer 1 provided on the surface of the substrate 305 opposite to the back surface layer 1, and a sliding surface layer 2 covering the sliding surface layer 1.

The back surface layer 1 includes conductors 301 (301*a* and 301*b*) provided along the longitudinal direction of the heater 300*b*. The conductors 301 include separate conductors 301*a* and 301*b*, and the conductor 301*b* is arranged on the downstream side of the conductor 301*a* in the conveying direction of the recording material P. The back surface layer 1 includes conductors 303 (303-1 to 303-7), which are arranged parallel to the conductors 301*a* and 301*b*. The conductors 303 are provided between the conductors 301*a* and 301*b* along the longitudinal direction of the heater 300*b*. Additionally, the back surface layer 1 includes heating elements 302*a* (302*a*-1 to 302*a*-7) and heating elements 302*b* (302*b*-1 to 302*b*-7). The heating elements 302*a* are provided between the conductor 301*a* and the conductors 303 and generate heat when supplied with electric power via the conductors 301*a* and 303. The heating elements 302*b* are provided between the conductor 301*b* and the conductors 303 and generate heat when supplied with electric power via the conductors 301*b* and 303.

The heating portion consisting of the conductors 301 and 303 and heating elements 302*a* and 302*b* is divided into seven heating blocks ($HB_1$ to $HB_7$) in the longitudinal direction of the heater 300*b*. That is, the heating elements 302*a* include seven divided regions of heating elements 302*a*-1 to 302*a*-7 arranged in the longitudinal direction of the heater 300*b*. The heating elements 302*b* also include seven divided regions of heating elements 302*b*-1 to 302*b*-7 arranged in the longitudinal direction of the heater 300*b*. Additionally, the conductors 303 include seven divided regions of conductors 303-1 to 303-7 positioned corresponding to the division of the heating elements 302*a* and 302*b*.

The heating area of the present embodiment extends from the left end of the heating block $HB_1$ as viewed in the drawing to the right end of the heating block $HB_7$ as viewed in the drawing, and has a total length of 220 mm. The heating blocks have the same longitudinal length of 31.4 mm, but they may have different lengths.

The back surface layer 1 also includes electrodes E ($E_1$ to $E_7$, $E_{8-1}$, and $E_{8-2}$). The electrodes $E_1$ to $E_7$ are provided in the regions of the conductors 303-1 to 303-7, respectively, and supply electric power to the heating blocks $HB_1$ to $HB_7$ via the conductors 303-1 to 303-7, respectively. The electrodes $E_{8-1}$ and $E_{8-2}$ are provided at the longitudinal ends of the heater 300*b* to be connected to the conductors 301, and supply electric power to the heating blocks $HB_1$ to $HB_7$ via the conductors 301. In the present embodiment, the electrodes $E_{8-1}$ and $E_{8-2}$ are provided at both longitudinal ends of the heater 300*b*, but only the electrode $E_{8-1}$ may be provided at one end, for example. The conductors 301*a* and 301*b* are supplied with electric power via common electrodes, but individual electrodes may be provided for each of the conductors 301*a* and 301*b* to supply power to each conductor.

The back surface layer 2 is formed by an insulative surface protective layer 307 (glass in this embodiment), and covers the conductors 301 and 303 and the heating elements 302*a* and 302*b*. The surface protective layer 307 is formed except for the sections of the electrodes E, so that the electric contacts C are connectable to the electrodes E from the side corresponding to the back surface layer 2 of the heater 300*b*.

The sliding surface layer 1 is provided on the surface of the substrate 305 opposite to the surface on which the back surface layer 1 is provided, and includes thermistors TH (TH1-1 to TH1-4 (THERMISTOR GROUP 1) and TH2-5 to TH2-7 (THERMISTOR GROUP 2)) for detecting the temperatures of the heating blocks HB1 to HB7. The thermistors TH are made of a material having the PTC characteristics or the NTC characteristics (the NTC characteristics in this embodiment), and their values of resistance are detected to detect the temperatures of the heating blocks. To energize the thermistors TH and detect their resistance values, the sliding surface layer 1 includes conductors ET (ET1-1 to ET1-4 and ET2-5 to ET2-7) and conductors EG (EG1 and EG2). The conductors ET1-1 to ET1-4 are connected to the thermistors TH1-1 to TH1-4 (THERMISTOR GROUP 1), respectively. The conductors ET2-5 to ET2-7 are connected to the thermistors TH2-5 to TH2-7 (THERMISTOR GROUP 2), respectively. The conductor EG1 is connected to four thermistors TH1-1 to TH1-4 to form a common conductive path. The conductor EG2 is connected to three thermistors TH2-5 to TH2-7 to form a common conductive path. Each of the conductors ET and EG extends in the longitudinal direction of the heater 300*b* to the corresponding longitudinal end and is connected to the control circuit 400 via an electric contact (not shown) at the longitudinal end of the heater 300*b*.

The sliding surface layer 2 is formed by a surface protective layer 308 having sliding and insulating characteristics (glass in this embodiment), covers the thermistors TH and the conductors ET and EG, and provides sliding characteristics against the inner surface of the fixing film 202. To place electric contacts for the conductors ET and EG, the surface protective layer 308 is formed except for the longitudinal ends of the heater 300*b*. A method for connecting electric contacts C to the electrodes E is now described.

FIG. 6C is a plan view of a state in which the electric contacts C are connected to the electrodes E as viewed from the heater holding member 201. The heater holding member 201 has through holes at positions corresponding to the electrodes E ($E_1$ to $E_7$, $E_{8-1}$, and $E_{8-2}$). At the positions of the through holes, the electric contacts C ($C_1$ to $C_7$, $C_{8-1}$, and $C_{8-2}$) are electrically connected to the electrodes E ($E_1$ to $E_7$, $E_{8-1}$, and $E_{8-2}$) by a means such as urging with a spring or welding. The electric contacts C are connected to the control circuit 400 of the heater 300*b*, which will be described below, via a conductive material (not shown) provided between the metal stay 204 and the heater holding member 201.

2. Heater Control Circuit Configuration (Common to Division Heaters)

Figure 7:
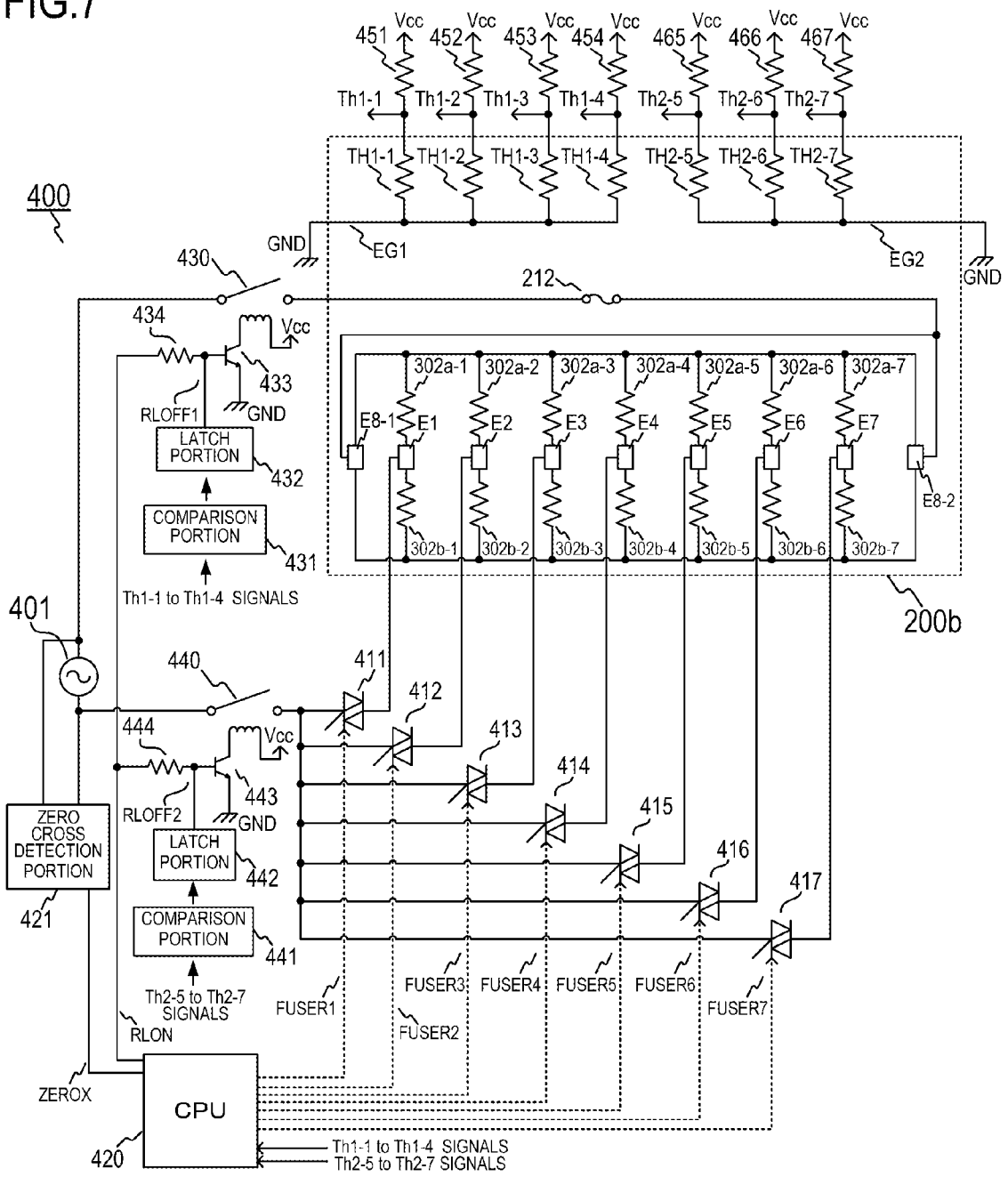
FIG. 7 is a circuit diagram of a heater control circuit of Embodiment 2 according to the present invention.

FIG. 7 is a circuit diagram of the control circuit 400 of the heater 300*b* of Embodiment 1. The image formation apparatus 100 is connected to a commercial AC power source 401. The power of the heater 300*b* is controlled by energization/cutoff of triacs 411 to 417. The triacs 411 to 417 operate according to FUSER1 to FUSER7 signals from a CPU 420, respectively. The drive circuits of the triacs 411 to 417 are not shown. The control circuit 400 of the heater 300*b* has a circuit configuration in which the seven triacs 411 to 417 independently control the seven heating blocks $HB_1$ to $HB_7$. A zero cross detection portion 421 is a circuit that detects the zero cross point of the commercial AC power supply 401 that activates the image formation apparatus 100, and outputs a zero cross signal to the CPU 420. The zero cross signal is used to detect the timing for phase control and wave number control of the triacs 411 to 417, for example.

A method for detecting the temperature of the heater 300*b* is now described. The thermistors TH (TH1-1 to TH1-4 and TH2-5 to TH2-7) detect the temperature of the heater 300*b*. The CPU 420 detects the voltage division of the thermistors TH1-1 to TH1-4 and resistors 451 to 454 as Th1-1 to Th1-4 signals, and converts the Th1-1 to Th1-4 signals into temperatures. Likewise, the CPU 420 detects the voltage division of the thermistors TH2-5 to TH2-7 and the resistors 465 to 467 as Th2-5 to Th2-7 signals, and converts the Th2-5 to Th2-7 signals into temperatures.

In the internal processing of the CPU 420, the electric power to be supplied is calculated by, for example, the proportional integration control (PI control) based on the control target temperatures TGTi of heating blocks, which will be described below, and the detection temperatures of the thermistors TH. Further, the electric power to be supplied is converted into control levels of the phase angle (phase control) and the wave number (wave number control) corresponding to this electric power, and the triacs 411 to 417 are controlled according to the obtained control conditions. As the control portion and obtainment portion of the present invention, the CPU 420 may perform various calculations and energization controls relating to the temperature control of the heater 300*b*.

Relays 430 and 440 ensure safety by serving as a means for shutting off the electric power to the heater 300*b* when the temperature of the heater 300*b* rises excessively due to a failure or the like. When any of the temperatures detected by the thermistors TH1-1 to TH1-4 exceeds the respective predetermined temperatures, the relay 430 is set in a non-conducting state to ensure safety. Likewise, when any of the detected temperatures by the thermistors TH2-5 to TH2-7 exceeds the respective predetermined temperatures, the relay 440 is set in a non-conducting state to ensure safety.

When a RLON signal is in high state, a transistor 433 is turned ON, a secondary coil of the relay 430 is energized from power-supply voltage Vcc, and a primary contact of the relay 430 is turned ON. When the RLON signal is in low state, a transistor 433 is turned OFF, the current flowing from the power-supply voltage Vcc to a secondary coil of the relay 430 is cut off, and a primary contact of the relay 430 is turned OFF. Likewise, when the RLON signal is in high state, the transistor 443 is turned ON, the secondary coil of the relay 440 is energized from the power-supply voltage Vcc, and the primary contact of the relay 440 is turned ON. When the RLON signal is in low state, the transistor 443 is turned OFF, the current flowing from the power-supply voltage Vcc to the secondary coil of the relay 440 is cut off, and the primary contact of the relay 440 is turned OFF. Resistors 434 and 411 are current limiting resistors.

When any of the temperatures detected by the thermistors TH1-1 to TH1-4 exceeds the respective predetermined values, a comparison portion 431 operates a latch portion 432, and the latch portion 432 latches a RLOFF1 signal in low state. When the RLOFF1 signal is in low state, the transistor 433 is kept in OFF state even if the CPU 420 sets the RLON signal in high state, so that the relay 430 is kept in OFF state (safe state). The latch portion 432 in non-latch state outputs the RLOFF1 signal in open state. Likewise, when any of the temperatures detected by the thermistors TH2-5 to TH2-7 exceeds the respective predetermined values, a comparison portion 441 operates a latch portion 442, and the latch portion 442 latches a RLOFF2 signal in low state. When the RLOFF2 signal is in low state, the transistor 443 is kept in OFF state even if the CPU 420 sets the RLON signal in high state, so that the relay 440 is kept in OFF state (safe state). Additionally, the latch portion 442 in non-latch state outputs the RLOFF2 signal in open state.

3. Heating Region

Figure 8:
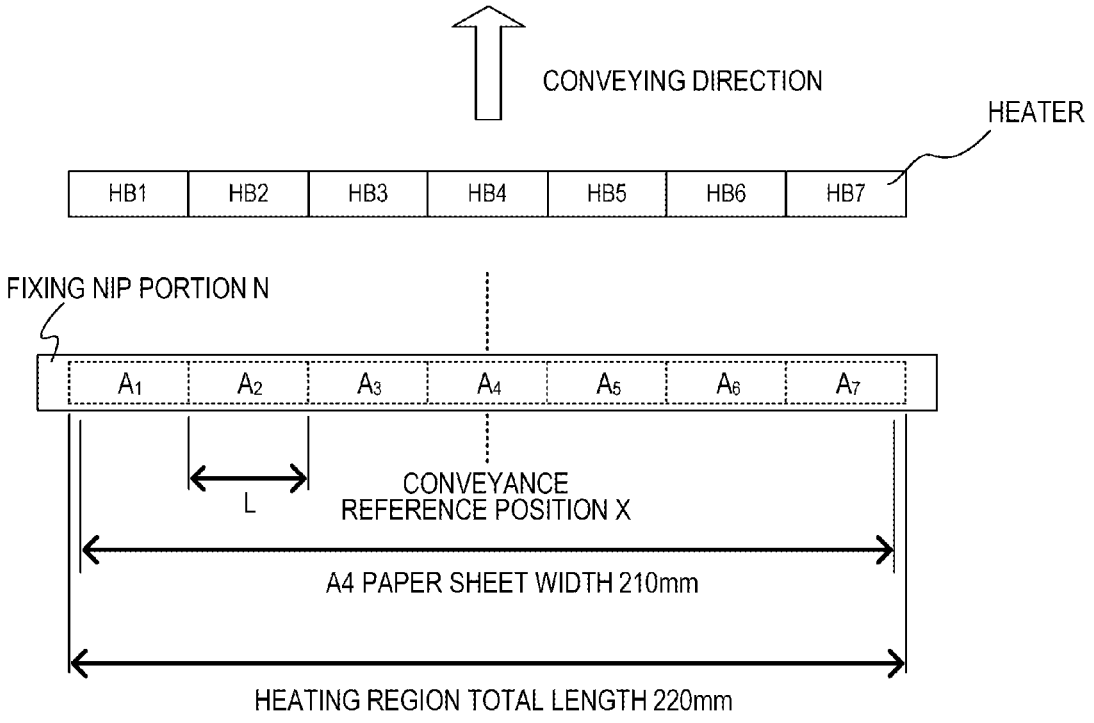
FIG. 8 is a diagram illustrating heating regions of Embodiment 2 according to the present invention.

FIG. 8 is a diagram showing the relationship between the heating blocks of the heater 300*b* and heating regions $A_1$ to $A_7$ in the present embodiment, with reference to an A4-sized recording material. The heating regions $A_1$ to $A_7$ are provided at positions in the fixing nip portion N corresponding to the heating blocks $HB_1$ to $HB_7$, and the heating regions $A_i$ (i=1 to 7) are heated by the heat of the respective heating blocks $HB_i$ (i=1 to 7). The total length of the heating regions $A_1$ to $A_7$ is 220 mm, and the regions are defined by dividing the total length into seven equal parts (L=31.4 mm).

Figures 9A, 9B:
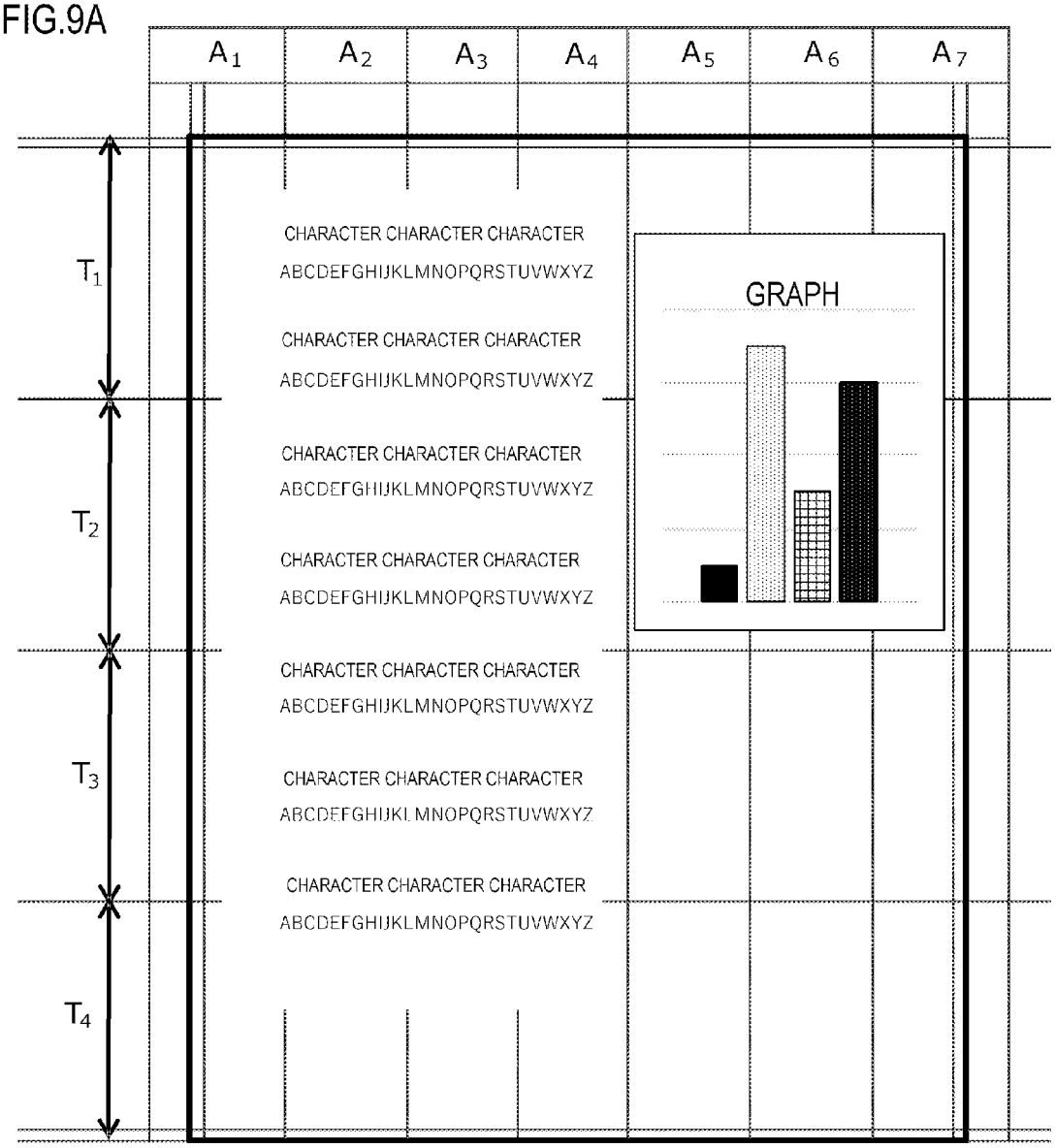
FIGS. 9A and 9B are diagrams illustrating the heating regions of Embodiment 2 according to the present invention.

Referring to FIGS. 9A and 9B, the classification of the heating regions Ai according to the position of the toner image formed on a recording material P is now described. In the present embodiment, the recording material P passing through the fixing nip portion N is divided into sections with respect to a predetermined time Tn, and the recording material in-process temperature control is performed for each heating region $A_i$. The present embodiment is characterized in that the sectioning is based on one rotation cycle of the fixing film (75.4 mm). From the leading edge of the recording material P, the first section is a section $T_1$, the second section is a section $T_2$, the third section is a section $T_3$, the fourth section is a section $T_4$, and so on. The heating regions $A_i$ are classified as shown in the table of FIG. 9B when the recording material P is of such a size that its ends in the direction perpendicular to the conveying direction (hereinafter referred to as recording material width ends) pass through the heating regions $A_1$ to $A_7$ and an image is present in the position shown in FIG. 9A. As for the sections $T_1$ and $T_2$, the image area passes through each of the heating regions $A_1$ to $A_7$, and thus the heating regions $A_1$ to $A_7$ are classified as image heating region AI (Image of Area). As for the sections $T_3$ and $T_4$, the heating regions $A_1$ to $A_4$ are classified as image heating regions AI, and the heating regions $A_5$ to $A_7$ are classified as non-image heating regions AP (Paper of Area) because the image area does not pass through these regions. The recording material P shown in FIG. 9A is of A4-sized, and the recording material P passes through all the heating regions $A_i$. However, if the width of the recording material P is smaller and the recording material P does not pass through the heating region $A_1$ or $A_7$, these regions are classified as non-paper heating regions AN (Non Paper of Area).

4. Overview of Heater Control Method

A method for controlling the heater 300*b* of the present embodiment according to the classification of the heating regions $A_i$, that is, a method for controlling the heating amounts of the heating blocks $HB_i$ (i=1 to 7) is now described. The electric power supplied to the heating blocks $HB_i$ determines the amount of heat generated by each heating block $HB_i$. The amount of heat generated by a heating block $HB_i$ increases when more electric power is supplied to the heating blocks $HB_i$. The amount of heat generated by a heating block $HB_i$ decreases when less electric power is supplied to the heating blocks $HB_i$. The electric power to be supplied to the heating blocks $HB_i$ is calculated based on the control target temperature $TGT_i$ (i=1 to 7) set for each heating block and the detection temperatures of the thermistors TH1-1 to 4 and TH2-5 to 7. The present embodiment calculates the electric power to be supplied by the PID control such that the detection temperatures of the thermistors TH1-1 to TH1-4 and TH2-5 to TH2-7 are equal to the control target temperatures $TGT_i$ of the heating blocks $HB_i$.

Figure 10:
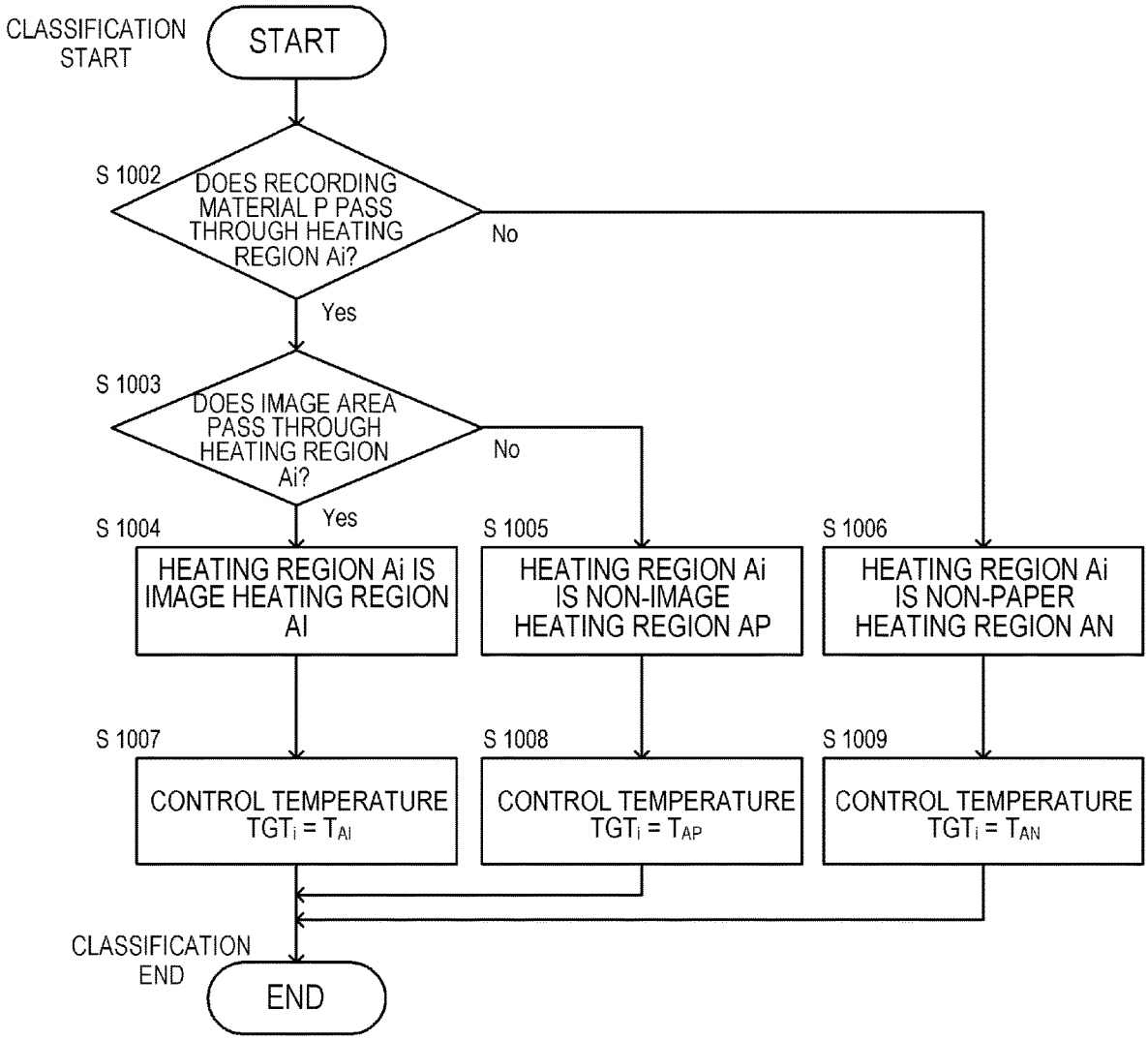
FIG. 10 is a flow chart of the heater control of Embodiment 2 according to the present invention.

The control target temperature $TGT_i$ of each heating block is set according to the classification of the heating region $A_i$ determined as shown in the flowchart of FIG. 10. Each heating region $A_i$ is classified based on the image data (image information) sent from an external device (not shown), such as a host computer, and the size information of the recording material P. That is, upon starting the classification (CLASSIFICATION START), it is determined whether the recording material P passes through the heating region $A_i$ (S1002), and if the recording material P does not pass, the heating region $A_i$ is classified as a non-paper heating region AN (S1006). If the recording material P passes through the heating region $A_i$, it is determined whether the image area passes through the heating region $A_i$ (S1003). If the image area passes, the heating region $A_i$ is classified as an image heating region AI (S1004), and if the image area does not pass, the heating region $A_i$ is classified as a non-image heating region AP (S1005).

A situation where the heating region $A_i$ is classified as an image heating region AI (S1004) is now described. When the heating region $A_i$ is classified as an image heating region AI, the control target temperature $TGT_i$ is set as $TGT_i=T_{AI}$ (S1007), after which the classification ends (CLASSIFICATION END). $T_{AI}$ denotes an image heating region reference temperature, which is set as a temperature suitable to fix an unfixed toner image to the recording material P. When the fixing apparatus 200*b* of the present embodiment performs fixing on plain paper, the image heating region reference temperature $T_{AI}$=220° C. It is desirable that the image heating region reference temperature $T_{AI}$ be corrected by the paper type control described in Embodiment 1. The present embodiment with the division heater 300*b* uses the maximum toner amount, which serves as the toner image information of each heating region $A_i$, and changes the image heating region reference temperature $T_{AI}$ with the correction values shown in Table 3 to save energy. That is, the correction value is 0 for the full secondary-color, which has adverse effects on the fixing performance, and the image heating region reference temperature $T_{AI}$ is corrected with a smaller value for a smaller maximum toner amount.

TABLE 3

| | Maximum toner deposition amount [%] | | | | |
|---|---|---|---|---|---|
| | 105 or less | 106~140 | 141~170 | 171~200 | 201~230 |
| Correction value [° C.] | −4 | −3 | −2 | −1 | ±0 |

A situation where the heating region $A_i$ is classified as a non-image heating region AP (S1005) is now described. When the heating region $A_i$ is classified as a non-image heating region AP, the control target temperature $TGT_i$ is set as $TGT_i=T_{AP}$ (S1008), after which the classification ends (CLASSIFICATION END). $T_{AP}$ denotes a non-image heating region reference temperature, which is set to a value lower than the image heating reference temperature $T_{AI}$ so that the amount of heat generated by a heating block $HB_i$ for a non-image heating region AP is lower than that for an image heating region AI, thereby reducing the power consumed by the image formation apparatus 100. However, an excessively low non-image heating region reference temperature $T_{AP}$ may cause the temperature to fail to rise to the control target temperature $T_{AP}$ for the image portion when the heating region $A_i$ changes from a non-image heating region AP to an image heating region AI even if the largest possible electric power is applied to the heating block $HB_i$. In this case, faulty fixation, which is a phenomenon where a toner image is not reliably fixed to the recording material P, can occur. The non-image heating region reference temperature $T_{AP}$ therefore needs to be set to an appropriate value. According to experiments conducted by the inventor and others, no faulty fixation is found to occur when the non-image heating region reference temperature $T_{AP}$ is greater than or equal to 162° C. in the fixing apparatus 200*b* of the present embodiment. From the viewpoint of power saving, it is desirable to lower the control target temperature $TGT_i$ and the amount of heat generated by the heating blocks $HB_i$ to the extent possible. As such, $T_{AP}$=162° C. in the present embodiment.

In the control described above, the heating regions $A_5$ to $A_7$ are classified as image heating regions AI for the sections $T_1$ and $T_2$ and controlled with the image heating reference temperature $T_{AI}$ as the control target temperature. For the sections $T_3$ and $T_4$, the heating regions $A_5$ to $A_7$ are classified as non-image heating region AP and controlled with the non-image heating reference temperature $T_{AP}$ as the control target temperature.

When a heating region $A_i$ is classified as a non-paper heating region AN, the control target temperature $TGT_i$ is set to $TGT_i=T_{AN}$ (S1009), after which the classification ends (CLASSIFICATION END). $T_{AN}$ denotes a non-paper heating region reference temperature, which is set to a value lower than the non-image heating reference temperature $T_{AP}$ so that the amount of heat generated by a heating block $HB_i$ for a non-paper heating region AN is lower than that for a non-image heating region AP, thereby reducing the power consumed by the fixing apparatus 200*b*. However, an excessively low non-paper heating region reference temperature $T_{AN}$ reduces the sliding characteristics between the inner surface of the fixing film 202 and the heater 300*b*, leading to unstable conveyance of the recording material P. This is due to the viscosity characteristics of the sliding grease between the fixing film 202 and the heater 300*b*. The viscosity of the sliding grease increases as the temperature decreases, hindering the rotation of the fixing film 202. According to experiments conducted by the inventor and others, the conveyance of the recording material P is found to be stable when the non-paper heating region reference temperature $T_{AN}$ is greater than or equal to 128° C. in the fixing apparatus 200*b* of the present embodiment. From the viewpoint of power saving, it is desirable to lower the control target temperature $TGT_i$ and the amount of heat generated by the heating blocks $HB_i$ to the extent possible. To this end, $T_{AP}$=128° C. in the present embodiment. The non-paper heating region reference temperature $T_{AN}$ should be determined in consideration of the configuration of the fixing apparatus 200*b*, including the viscosity characteristics of the grease, and is not limited to 128° C.

5. Recording Material In-Process Temperature Control

The recording material in-process temperature control of Embodiment 2 is now described. The conventional recording material in-process temperature control uses the correction values shown in FIG. 4 of Embodiment 1 to secure the fixing performance toward the trailing edge of the recording material P even when a secondary-color image, which has the largest maximum toner amount, is formed over the entire area. Embodiment 2 optimizes the correction values of the recording material in-process temperature control according to the toner image information corresponding to each heating region. Since a plurality of divided heating elements is provided, Embodiment 2 performs the recording material in-process temperature control that is more suited to the toner image, as compared with Embodiment 1. As toner image information, Embodiment 2 uses the maximum toner amount and the toner occupancy ratio as in Embodiment 1.

The control target temperatures for the image shown in FIG. 9A are now described.

The graph corresponding to the heating regions $A_5$ to $A_7$ is formed by secondary colors and has a maximum toner amount of 200%. Thus, the control target temperature TGTi is the image heating region reference temperature−the maximum toner amount correction value, which is 222−0=222 [° C.]. Since the toner occupancy ratio is 23%, the correction of the recording material in-process temperature control uses the same temperature of +6° C. according to Table 2 in the comparison example and Embodiment 2.

The character portion corresponding to the heating regions $A_1$ to $A_4$ has a maximum toner amount of 100%, and thus the control target temperature TGTi=the image heating region reference temperature−the maximum toner amount correction value, which is 222−4=218 [° C.]. The corrections of the recording material in-process temperature control of the comparison example uses a value of +6° C. since the comparison example is not based on toner image information. In contrast, Embodiment 2 uses a correction value of +1° C., which is the correction value suitable for a toner occupancy ratio of 4% according to Table 2.

Figure 11:
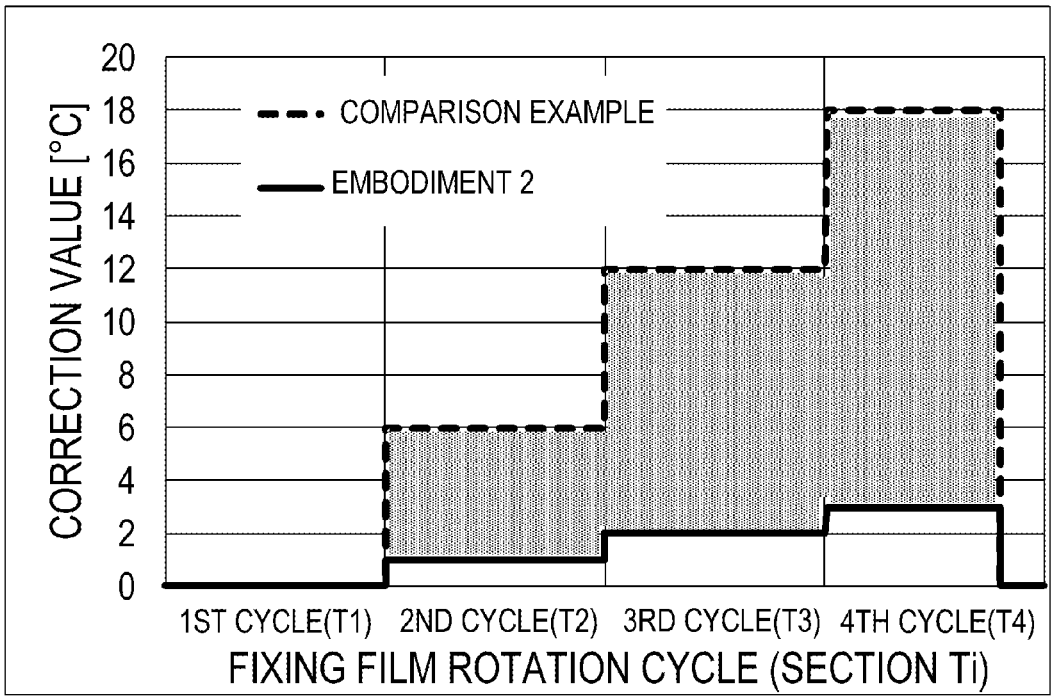
FIG. 11 is a diagram illustrating a temperature control of Embodiment 2 according to the present invention.

FIG. 11 shows the control target temperatures of the recording material in-process temperature control for the heating regions $A_1$ to $A_4$ of the comparison example and Embodiment 2. The recording material in-process temperature control based on the toner amount makes smaller corrections to the control target temperature for the heating regions $A_1$ to $A_4$, resulting in a lower target temperature. This reduces the heat amount corresponding to the shaded section.

6. Advantageous Effects of Present Embodiment

Embodiment 2 has an advantageous effect of reducing the amount of heat applied to the recording material P as described below. This advantageous effect was verified by referring to the curling of the recording material P also in Embodiment 2. The verification conditions were the same as those in Embodiment 1, and the same image formation apparatus 100 as in Embodiment 1 was used except for the fixing apparatus 200*b* having the division heater 300*b*. Table 4 shows the verification results.

TABLE 4

| | Recording material in-process temperature control [° C.] | | Curl [mm] | |
|---|---|---|---|---|
| | Heating regions $A_{1-4}$ | Heating regions $A_{5-7}$ | Average value | Difference between right and left |
| Comparison example | +6 | +6 | 14 | 9 |
| Embodiment 2 | +1 | +6 | 6 | 3 |

As shown in Table 4, in addition to reducing the curling, the recording material in-process temperature control of Embodiment 2 is verified to reduce the difference between the left side curling and the right side curling.

The difference between the left side curling and right side curling is now described. In the comparison example, the amount of heat in the heating regions $A_5$ to $A_7$ is suitable for the toner amount, but the amount of heat in the heating regions $A_1$ to $A_4$ is excessively large for the toner amount. This results in larger curls on the left side of the recording material P, creating the difference between the right side curling and the left side curling. In contrast, Embodiment 2 reduces the control target temperature for the heating regions $A_1$ to $A_4$ corresponding to a smaller amount of toner, allowing for a uniform heat amount given to the left and right sides of the recording material P. This eliminates the difference between the right side curling and the left side curling. The fixing member and the pressure member do not receive an excessive amount of heat, and therefore the degrees of thermal deterioration of these members are small. That is, in addition to the effect of reducing the heat amount corresponding to the shaded section in FIG. 10, the increased durability improves the stability of the image heating apparatus.

<Application Mode 1 of Embodiment 2>

Figure 12:
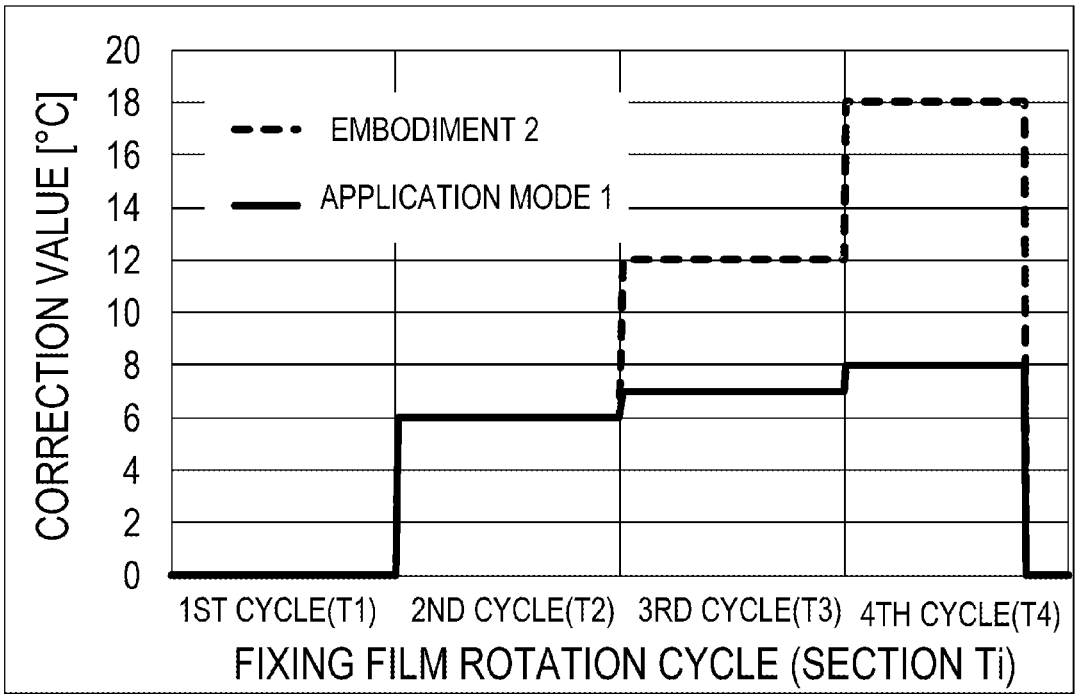
FIG. 12 is a diagram illustrating a temperature control of Embodiment 2 according to the present invention.

In Embodiment 2, the correction value of the recording material in-process temperature control of the heating regions $A_5$ to $A_7$ is +6 [° C.], which is suitable for the maximum toner amount in the sections $T_1$ and $T_2$, is also used to correct the sections $T_3$ and $T_4$. Alternatively, the following Application Mode 1 may be used. The corrections for the sections $T_3$ and $T_4$ without a toner image are performed using the correction value of the recording material in-process temperature control that is suitable for a section without a toner image (that is, the maximum toner amount and the toner occupancy ratio in the regions corresponding to the sections $T_3$ and $T_4$ are both 0%), which is +1 [° C.] according to Table 2. FIG. 12 shows the transition of the control target temperature in Application Mode 1 of Embodiment 2.

<Application Modes 2 and 3 of Embodiment 2>

Figure 13:
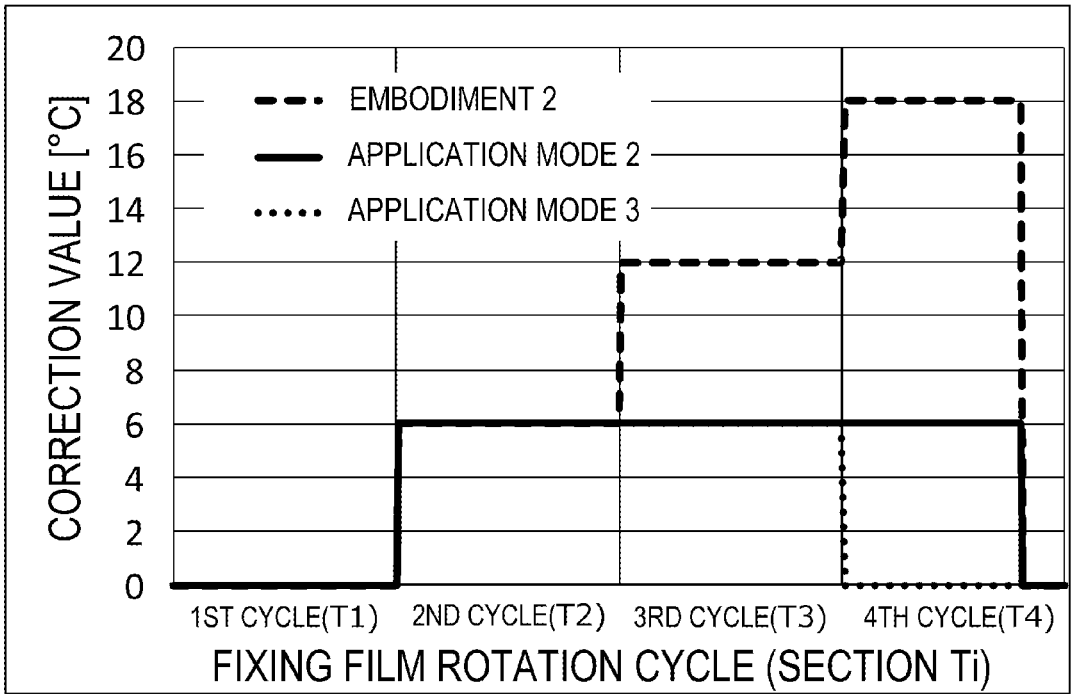
FIG. 13 is a diagram illustrating a temperature control of Embodiment 2 according to the present invention.

In another application mode, the recording material in-process temperature control does not make corrections for the section $T_3$ without a toner image, and the image heating reference temperature $T_{AI}$ for the section $T_2$, which is 228 [° C.], is maintained. FIG. 13 shows the transition of the control target temperature in Application Mode 2 of Embodiment 2.

In a derivative example of Application Mode 2, the control target temperature for the section $T_4$, which is the latter of successive sections without a toner image, is set to the image heating reference temperature $T_{AI}$ of 222 [° C.], in preparation for the fixing of the subsequent recording material P. FIG. 13 shows the transition of the control target temperature in Application Mode 3 of Embodiment 2. In this example, the temperature is modified from the section $T_4$, but the temperature may be reset from the section $T_3$, which is the first one of the successive sections without a toner image.

<Application Modes 4 and 5 of Embodiment 2>

Figure 14:
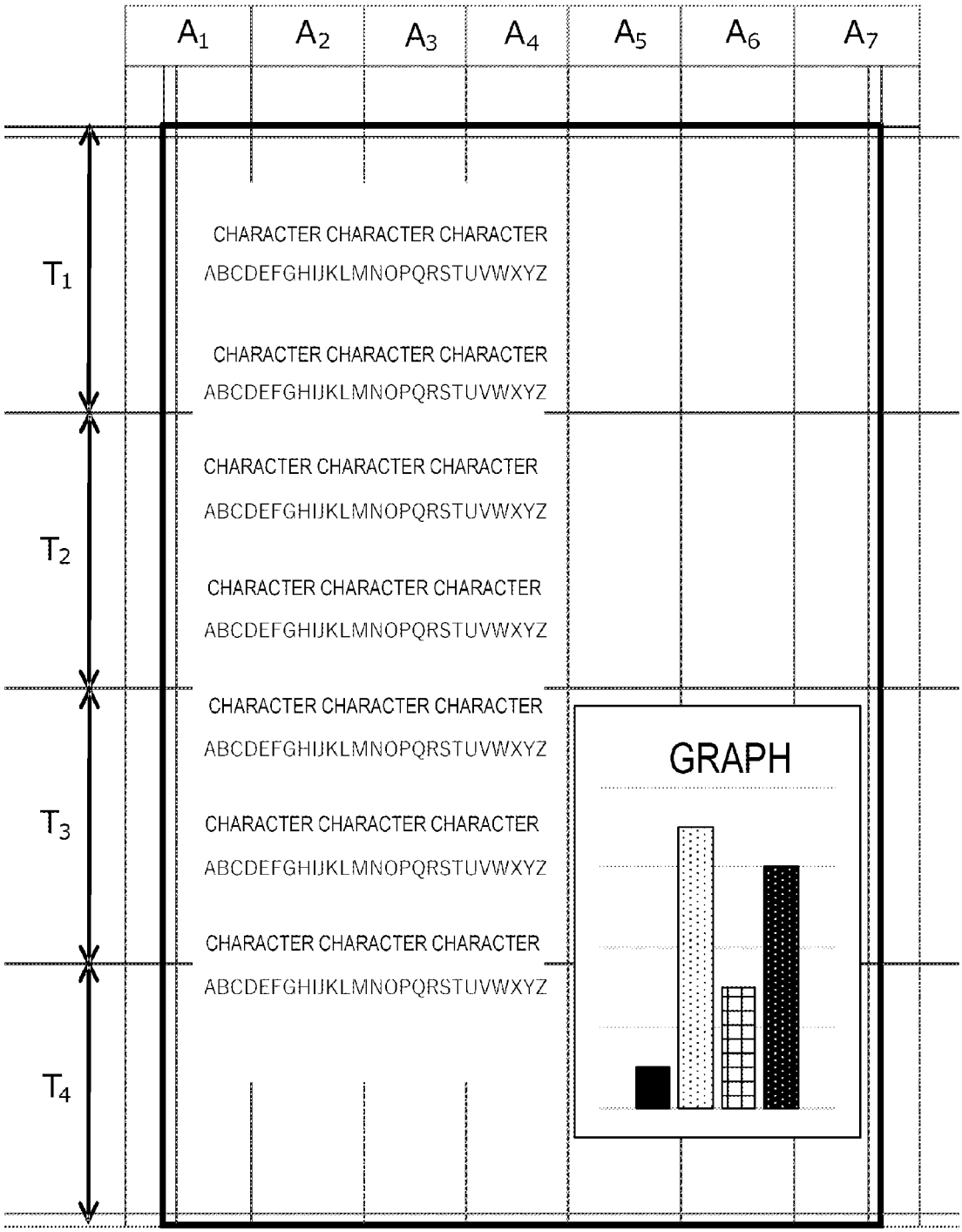
FIG. 14 is a diagram illustrating the heating regions of Embodiment 2 according to the present invention.
Figure 15:
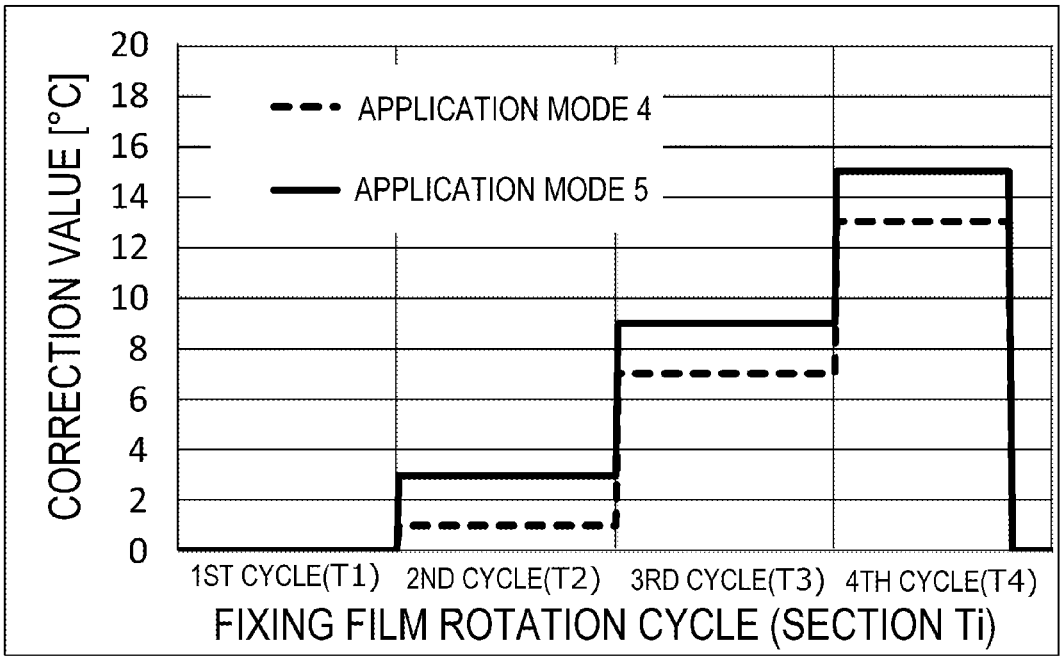
FIG. 15 is a diagram illustrating a temperature control of Embodiment 2 according to the present invention.

Application Modes 1 to 3 described above are examples in which the heating regions $A_5$ to $A_7$ for the leading sections $T_1$ and $T_2$ of the recording material P correspond to a toner image, like the image of FIG. 9A. Application Mode 4 may be used for an image having a toner image in the trailing sections $T_3$ and $T_4$ as shown in FIG. 14. The recording material in-process temperature control of the heating regions $A_5$ to $A_7$ for such an image uses the control target temperatures shown in FIG. 15 to control according to the presence or absence of a toner image. In Application Mode 4 shown in FIG. 15, the recording material in-process temperature control of the heating regions $A_5$ to $A_7$ for the sections $T_1$ and $T_2$ without a toner image uses a correction value of +1 [° C.] according to Table 2 (that is, the maximum toner amount and the toner occupancy ratio in the regions corresponding to the sections $T_1$ and $T_2$ are both 0%). In contrast, a correction value of +6 [° C.] is used for the sections $T_3$ and $T_4$ with a toner image (that is, the maximum toner amount is 200%, and the toner occupancy ratio is about 23% in the regions corresponding to the sections $T_3$ and $T_4$).

Application Mode 5, which is a derivative example of Application Mode 4, starts corrections from the section $T_2$ as the recording material in-process temperature control in preparation for the fixing of the section $T_3$ with a toner image. Although the section $T_2$ does not have a toner image, the subsequent section $T_3$ has a toner image. As such, the correction for the section $T_2$ of Application Mode 5 uses a correction value of +3 [° C.], which is larger than that of Application Mode 4. When a leading section $T_i$ in an image does not have a toner image and the subsequent section $T_i$ has a toner image, the correction value used in the recording material in-process temperature control performed in preparation for the section $T_i$ having a toner image is preferably set to a value suitable for the fixing apparatus 200*b* or the image formation apparatus 100.

Embodiment 2 performs, as the control based on the toner amount, the recording material in-process temperature control that uses the maximum toner amount and the toner occupancy ratio. However, the present invention is not limited to this and its objective may be achieved by a control based on either toner image information, or a control based on other toner image information.

As described above, in the image heating apparatus including the division heater having a plurality of heating elements of Embodiment 2 according to the present invention, the energization of the divided heating regions is independently controlled according to the image to be printed by a user, thereby reducing the curling. Embodiment 2 also has an advantageous effect of saving energy by reducing the amount of applying heat.

Embodiment 3

Embodiment 3 according to the present invention is now described. Embodiment 3 is an application example of Embodiment 2 and modifies the recording material in-process temperature control according to the toner image information corresponding to an adjacent heating region of the division heater. An electrophotographic image formation apparatus prints various images, many of which do not have a toner image on the right or left end.

Figure 16:
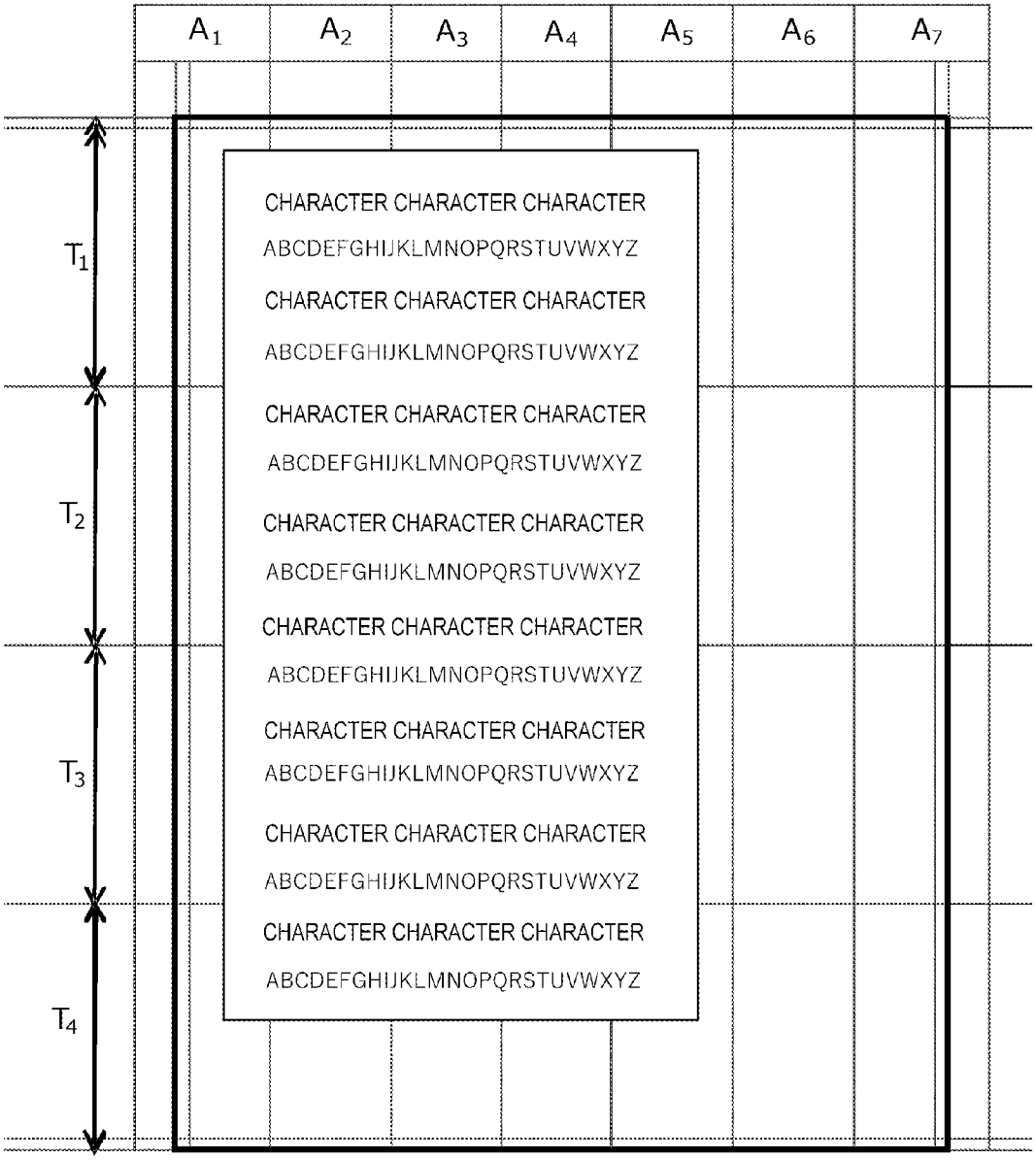
FIG. 16 is a diagram illustrating heating regions of Embodiment 3 according to the present invention.

For example, for the image shown in FIG. 16, the heating regions $A_1$ to $A_5$ are image heating regions with a toner image, while the heating regions $A_6$ and $A_7$ are non-image heating regions without a toner image. When such an image is continuously printed in a large quantity, it is found that the absence of a toner image that removes heat from the heating regions $A_6$ and $A_7$ increases the surface temperature of the section of the fixing film 202 corresponding to the heating regions $A_6$ and $A_7$, even with the corrections of the recording material in-process temperature control of Embodiment 2. After a large number of sheets have been continuously fed, the surface temperature of the section of the fixing film 202 corresponding to the heating regions $A_6$ and $A_7$ is found to be higher than that of the section corresponding to the heating regions $A_1$ to $A_5$. The surface temperature of the heating region $A_7$ is found to be particularly high. The toner image is present in the heating region $A_5$, which is adjacent to the heating region $A_6$. Thus, heat moves from the heating region $A_6$ into the heating region $A_5$, reducing a rise in the surface temperature of the section of the fixing film 202 corresponding to the heating region $A_6$. The heat is not removed from the heating region $A_7$ since a toner image is also absent in the adjacent heating region $A_6$, causing a significant rise in the surface temperature of the section of the fixing film 202 corresponding to the heating region $A_7$.

Figure 17:
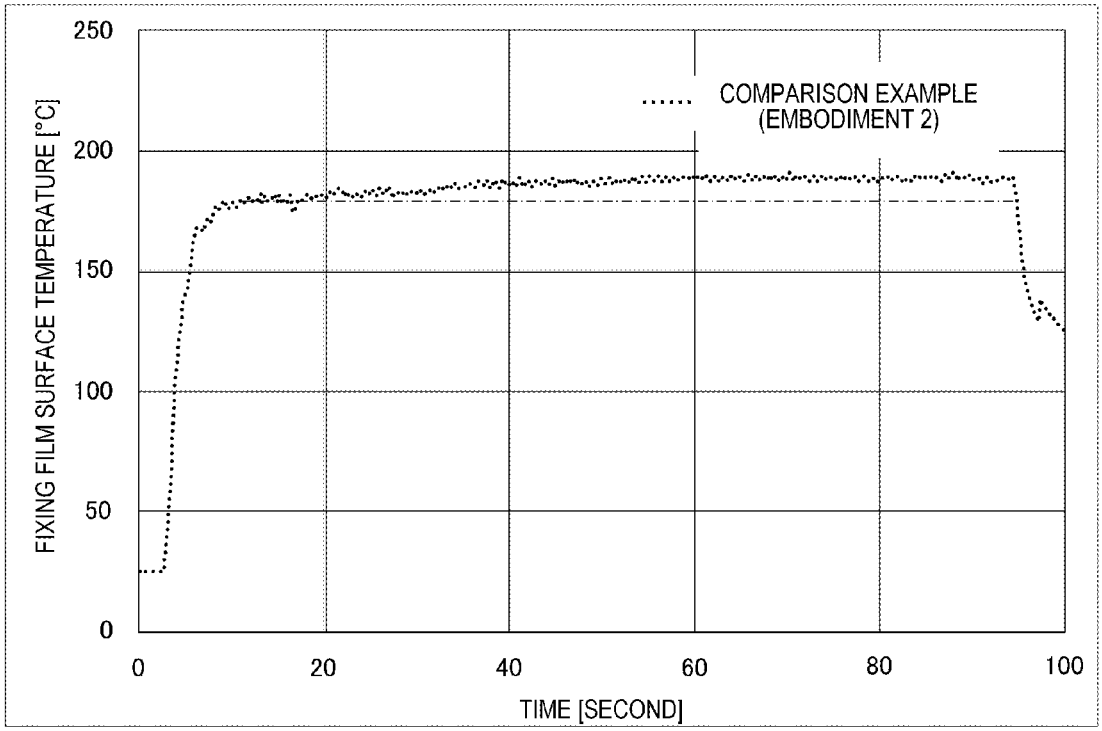
FIG. 17 is a graph illustrating a comparison example of Embodiment 3 according to the present invention.

FIG. 17 shows the measurement results of a comparison example. In this comparison example, the corrections of the recording material in-process temperature control of Embodiment 2 were made, and while a large number of sheets were continuously printed, the surface temperature of the section of the fixing film 202 corresponding to the heating region $A_7$ was measured immediately after each sheet passed out of the fixing nip. FIG. 17 shows that the temperature rose, although slowly, as a large number of sheets were continuously printed. It is found that hot offset can occur in the section corresponding to the heating region $A_7$, where a temperature rise is particularly large, when an image as shown in FIG. 18 is printed on the subsequent recording material P in a state where the surface temperature of the fixing film 202 is increased.

Figure 19:
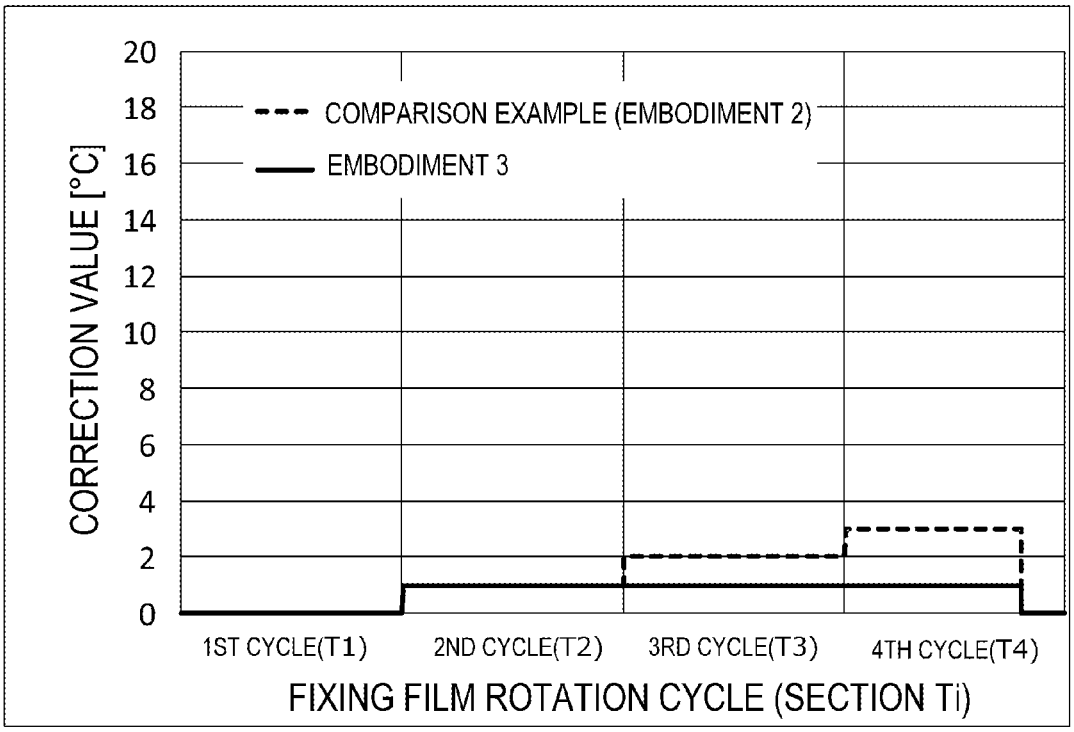
FIG. 19 is a diagram illustrating a temperature control of Embodiment 3 according to the present invention.

To solve this problem, the present embodiment sets the correction value of the recording material in-process temperature control to 0 for the heating regions $A_6$ and $A_7$, which are non-image heating regions, to limit a rise in the surface temperature of the fixing film 202. The present embodiment performs the recording material in-process temperature control as shown in FIG. 19. The present embodiment sets the correction value to 0 for the sections $T_3$ and $T_4$, which are closer to the trailing edge of the recording material. However, the timing for setting the correction value to 0 is not limited to this, and may be set as appropriate according to the apparatus configuration. For example, as long as it is possible to limit a rise in the surface temperature of the section of the fixing film 202 corresponding to the heating region $A_7$, the correction value may be set to 0 from the section $T_2$, or the correction value for the section $T_4$ may be set to 0.

Figure 18:
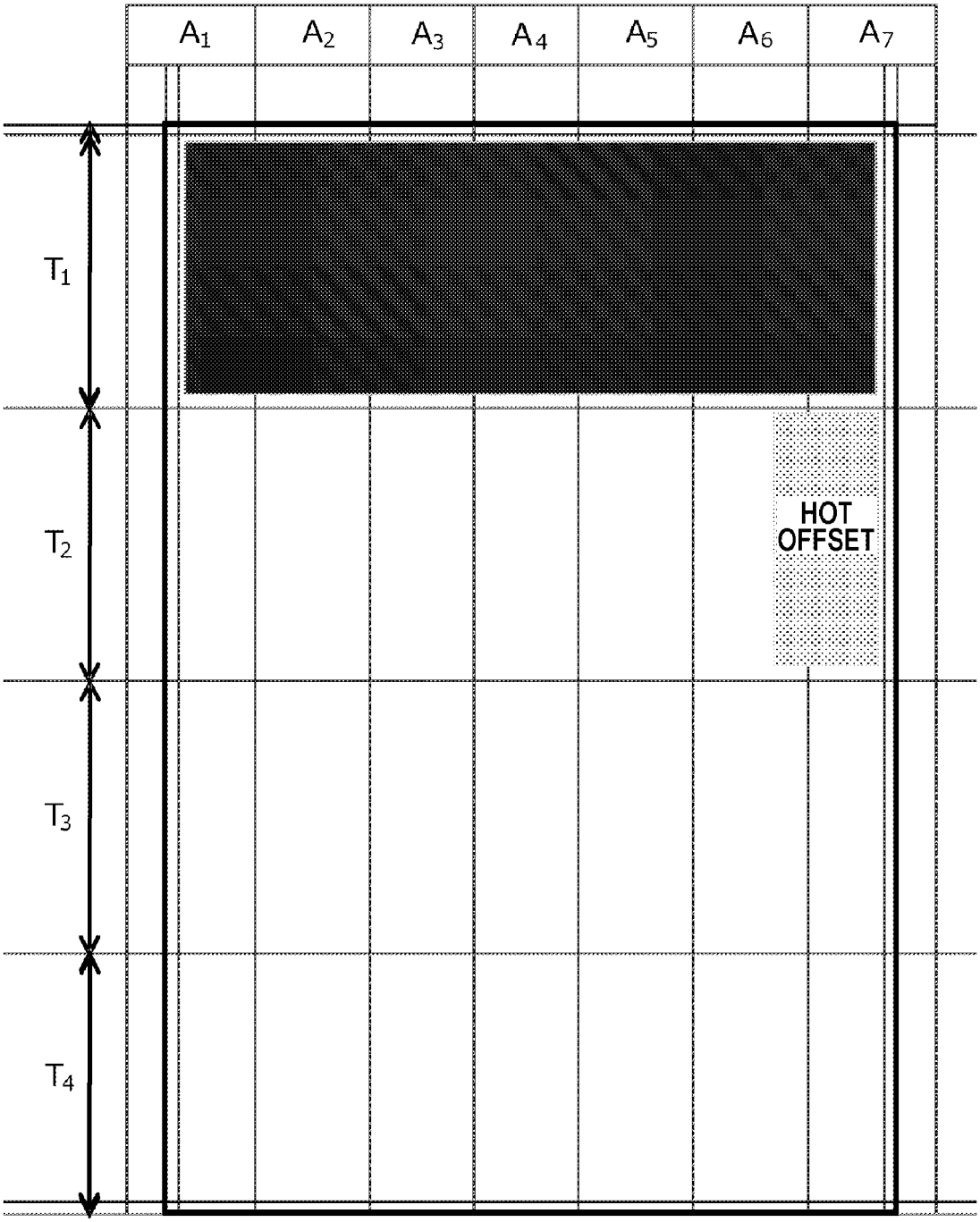
FIG. 18 is a diagram illustrating a comparison example of Embodiment 3 according to the present invention.

To verify the advantageous effects, it was verified, using the same fixing apparatus 200*b* including the division heater 300*b* as Embodiment 2, whether hot offset occurred with the image shown in FIG. 18 after the image shown in FIG. 16 was continuously fed. Embodiment 2 was used as a comparison example. Table 5 shows the verification results.

TABLE 5

| Number of sheets continuously fed [unit: sheets] | Hot offset: Comparison example (Embodiment 2) | Hot offset: Embodiment 3 |
|---|---|---|
| 20 | Did not occur | Did not occur |
| 25 | Did not occur | Did not occur |
| 30 | Occurred to some extent | Did not occur |
| 50 | Occurred | Did not occur |
| 80 | Occurred | Did not occur |

As shown in Table 5, with Embodiment 2 serving as the comparison example, hot offset did not occur after 25 or fewer sheets were continuously fed, but hot offset occurred after 30 sheets. In contrast, the present embodiment was found not to cause hot offset even after 80 sheets of continuous printing.

Figure 20:
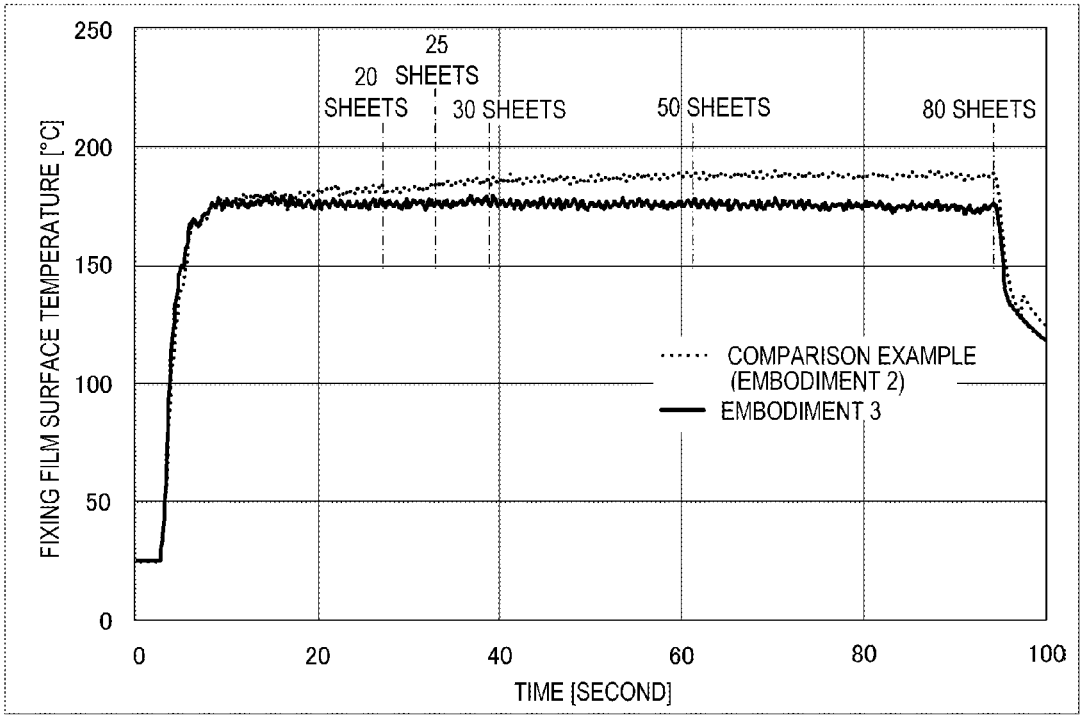
FIG. 20 is a graph illustrating Embodiment 3 according to the present invention.

FIG. 20 shows the results of measurement of the surface temperature of the section of the fixing film 202 corresponding to the heating region $A_7$ in the comparison example and the present embodiment. As shown in FIG. 20, in the comparison example, the temperature rises, although slowly, while the present embodiment limits a rise in the surface temperature of the fixing film 202, achieving an image heating apparatus that does not cause hot offset.

The present embodiment does not make a correction for the non-image heating region $A_i$ without a toner image by the recording material in-process temperature control. However, through the study of the present invention, it is found that the following application mode is also available. In this application mode, for an image with which non-image heating regions are adjacent to each other, as the heating regions $A_6$ and $A_7$ in FIG. 16, a negative value smaller than 0 may be used in the recording material in-process temperature control for the heating region $A_7$ adjacent to the heating regions $A_6$, which is a non-image heating region. This application mode is contemplated from the fact that, of the non-image heating regions $A_6$ and $A_7$, the fixing film 202 undergoes a larger temperature rise in the heating region $A_7$. A toner image is present in the heating region $A_5$, which is an image heating region adjacent to the heating region $A_6$. Thus, heat moves from the heating region $A_6$ into the heating region $A_5$, resulting in a small temperature rise in the section of the fixing film 202 corresponding to the heating region $A_6$. In contrast, heat is not removed from the heating region $A_7$ adjacent to the heating region $A_6$, which is a non-image heating region, and the surface of the section of the fixing film 202 corresponding to the heating region $A_7$ undergoes a large temperature rise. The correction value is thus set to a negative value. This allows the surface temperature of the fixing film 202 to be uniform.

Specifically, the recording material in-process temperature control for the non-image heating region $A_6$ adjacent to the image heating regions $A_1$ to $A_5$ uses a correction value of 0, that is, the temperature is not corrected. The recording material in-process temperature control for the non-image heating region $A_7$ adjacent to the non-image heating region $A_6$ uses −1 [° C.], that is, a negative correction is made. This limits a temperature rise and allows the surface temperature of the fixing film 202 to be uniform.

The correction value of the recording material in-process temperature control for a heating region $A_i$ without a toner image described in the present embodiment should be selected according to the fixing apparatus 200*b* and the image formation apparatus 100 to be used.

Additionally, the number of sheets that are continuously fed affects the temperature rise of the fixing film 202 in a non-image heating region. As such, an embodiment is conceivable in which the correction value is set to 0 when it is known that the number of sheets to be continuously fed is small, and a negative correction is made when it is known that the number of sheets to be continuously fed is large. In another embodiment, a negative correction starts while sheets are continuously fed.

Another possible configuration includes a means for detecting a temperature rise of the surface temperature of the fixing film 202, and changes the correction value of the recording material in-process temperature control according to the detected temperature.

As described above, in the image heating apparatus including the division heater having a plurality of heating elements of Embodiment 3, the corrections in the recording material in-process temperature control are changed according to the toner image information corresponding to an adjacent region. This achieves a uniform surface temperature of the fixing film 202 and stabilizes the image quality of the subsequent sheets.

The embodiments described above may be combined where possible.

The present invention is not limited to the above embodiments, and various modifications and variations can be made without departing from the spirit and scope of the present invention. Therefore, to apprise the public of the scope of the present invention, the following claims are appended.

According to the present invention, a more appropriate heating control can be performed according to the type of an image formed on the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

an image heating portion including a tubular film a heater provided in an inner space of the film, and a rotational pressure member that is in contact with an outer surface of the film and forms a nip portion for conveying a recording material between the outer surface of the film and the pressure member in cooperation with the heater, the image heating portion being configured to heat an unfixed toner image formed on the recording material using heat of the heater;

a temperature detection portion configured to detect a temperature of the heater;

a control portion configured to control electric power supplied to the heater such that the temperature detected by the temperature detection portion is maintained at a predetermined control target temperature; and an obtainment portion configured to obtain image information for forming the unfixed toner image, wherein the control target temperature is set, based on the image information, for each of a plurality of regions defined by dividing the recording material in a conveying direction, and wherein the plurality of regions is a plurality of regions defined by dividing the recording material in the conveying direction by a circumferential length of one of the film and the pressure member.

2. The image heating apparatus according to claim 1, wherein the control target temperature set for each of the plurality of regions is set to be higher for a region of the plurality of regions that is closer to a trailing edge of the recording material in the conveying direction.

3. The image heating apparatus according to claim 2, wherein an amount of increment of the control target temperature used in setting the control target temperature to be higher for a region closer to the trailing edge is smaller when the image information that is a maximum value of a toner amount per unit pixel of the unfixed toner image is smaller.

4. The image heating apparatus according to claim 2, wherein an amount of increment of the control target temperature used in setting the control target temperature to be higher for a region closer to the trailing edge is smaller when the image information that is a proportion of the unfixed toner image to an area of the recording material in which the unfixed toner image is formable is smaller.

5. The image heating apparatus according to claim 1, wherein the control target temperature set for each of the plurality of regions is set by cumulatively correcting a reference control target temperature from a region of the plurality of regions at a leading edge of the recording material to a region of the plurality of regions at a trailing edge of the recording material with a correction amount that is set based on the image information.

6. The image heating apparatus according to claim 5, wherein the correction amount varies for each of the plurality of regions.

7. The image heating apparatus according to claim 1, wherein:

the heater includes a plurality of heating elements arranged in a longitudinal direction perpendicular to the conveying direction of the recording material, the image heating portion is configured to heat an image formed on the recording material by heating a plurality of heating regions individually with the respective heating elements, and the control target temperature is set, based on the image information, for each of the plurality of regions in each of recording material regions in the recording material associated with the respective heating regions.

8. The image heating apparatus according to claim 7, wherein of the plurality of heating regions, the control target temperature for a heating region through which the unfixed toner image does not pass is lower than the control target temperature for a heating region through which the unfixed toner image passes.

9. The image heating apparatus according to claim 7, wherein a magnitude of the control target temperature for a certain heating region of the plurality of heating regions is set based on image information for forming an unfixed toner image in the recording material region associated with the certain heating region.

10. The image heating apparatus according to claim 9, wherein the magnitude of the control target temperature for the certain heating region is set for each of the plurality of regions based on image information for forming an unfixed toner image in each of regions defined by dividing the recording material region associated with the certain heating region corresponding to the plurality of regions.

11. The image heating apparatus according to claim 9, wherein of regions defined by dividing the recording material region associated with the certain heating region corresponding to the plurality of regions, the control target temperature for a region in which an unfixed toner image is not formed is lower than the control target temperature for a region in which an unfixed toner image is formed.

12. The image heating apparatus according to claim 7, wherein when a plurality of unfixed toner images that is formed with same image information is heated continuously, the control target temperatures set for the plurality of regions corresponding to a heating region of the plurality of heating regions through which the unfixed toner image does not pass include a control target temperature that is obtained by correcting a reference control target temperature with a correction amount of 0.

13. The image heating apparatus according to claim 12, wherein of heating regions of the plurality of heating regions through which the unfixed toner image does not pass, the control target temperature for a heating region that is not adjacent to a heating region through which the unfixed toner image passes is lower than the control target temperature for a heating region that is adjacent to a heating region through which the unfixed toner image passes.

14. An image formation apparatus comprising:

an image forming portion configured to form an unfixed toner image on a recording material; and a fixing portion configured to fix the unfixed toner image formed on the recording material to the recording material, wherein the fixing portion is the image heating apparatus according to claim 1.

15. An image heating apparatus comprising:

an image heating portion including a tubular film, a heater provided in an inner space of the film, and a rotational pressure member that is in contact with an outer surface of the film and forms a nip portion for conveying a recording material between the outer surface of the film and the pressure member in cooperation with the heater, the image heating portion being configured to heat an unfixed toner image formed on the recording material using heat of the heater;

a temperature detection portion configured to detect a temperature of the image heating apparatus;

a control portion configured to control electric power supplied to the heater such that the temperature detected by the temperature detection portion is maintained at a predetermined control target temperature; and an obtainment portion configured to obtain image information for forming the unfixed toner image, wherein the control target temperature is set, based on the image information, for each of a plurality of regions defined by dividing the recording material in a conveying direction, and wherein the plurality of regions is a plurality of regions defined by dividing the recording material in the conveying direction by a circumferential length of one of the film and the pressure member.

16. The image heating apparatus according to claim 15, wherein the control target temperature set for each of the plurality of regions is set to be higher for a region of the plurality of regions that is closer to a trailing edge of the recording material in the conveying direction.

17. The image heating apparatus according to claim 16, wherein an amount of increment of the control target temperature used in setting the control target temperature to be higher for a region closer to the trailing edge is smaller when the image information that is a maximum value of a toner amount per unit pixel of the unfixed toner image is smaller.

18. The image heating apparatus according to claim 16, wherein an amount of increment of the control target temperature used in setting the control target temperature to be higher for a region closer to the trailing edge is smaller when the image information that is a proportion of the unfixed toner image to an area of the recording material in which the unfixed toner image is formable is smaller.

19. The image heating apparatus according to claim 15, wherein the control target temperature set for each of the plurality of regions is set by cumulatively correcting a reference control target temperature from a region of the plurality of regions at a leading edge of the recording material to a region of the plurality of regions at a trailing edge of the recording material with a correction amount that is set based on the image information.

20. The image heating apparatus according to claim 19, wherein the correction amount varies for each of the plurality of regions.

* * * * *